US007102659B2

(12) United States Patent
Hayashi

(10) Patent No.: US 7,102,659 B2
(45) Date of Patent: Sep. 5, 2006

(54) INK SHEET CARTRIDGE AND EXCHANGEABLE INK-SHEET SET MOUNTED ON THE INK SHEET CARTRIDGE

(75) Inventor: Shigeyuki Hayashi, Gifu-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 565 days.

(21) Appl. No.: 09/820,704

(22) Filed: Mar. 30, 2001

(65) Prior Publication Data

US 2002/0024583 A1 Feb. 28, 2002

(30) Foreign Application Priority Data

| | | |
|---|---|---|
| Mar. 31, 2000 | (JP) | 2000-096817 |
| Mar. 31, 2000 | (JP) | 2000-096818 |
| Mar. 31, 2000 | (JP) | 2000-096819 |
| Mar. 31, 2000 | (JP) | 2000-096820 |
| Mar. 31, 2000 | (JP) | 2000-096821 |
| Mar. 31, 2000 | (JP) | 2000-096822 |
| Mar. 31, 2000 | (JP) | 2000-096823 |
| Feb. 23, 2001 | (JP) | 2001-047772 |

(51) Int. Cl.
*B41J 32/00* (2006.01)

(52) U.S. Cl. ..... 347/214; 400/208
(58) Field of Classification Search ..... 347/214; 400/207, 208
See application file for complete search history.

(56) References Cited

U.S. PATENT DOCUMENTS

| | | | |
|---|---|---|---|
| 4,029,268 | A | 6/1977 | Schoettle et al. |
| 4,673,304 | A | 6/1987 | Liu et al. |
| 4,687,358 | A | 8/1987 | Saitou |
| 4,914,452 | A | 4/1990 | Fukawa |
| 4,973,983 | A | 11/1990 | Yamamoto et al. |
| 5,044,794 | A | 9/1991 | Shimoyama et al. |
| 5,100,250 | A | 3/1992 | Suzuki et al. |

(Continued)

FOREIGN PATENT DOCUMENTS

| | | |
|---|---|---|
| EP | 0 423 647 A2 | 4/1991 |
| EP | 0 466 186 A2 | 1/1992 |
| EP | 0 475 404 A2 | 3/1992 |
| EP | 5 309927 | 11/1993 |
| EP | 0 593 821 A1 | 4/1994 |
| EP | 0 658 435 A1 | 6/1995 |
| EP | 09-272213 | 10/1997 |

(Continued)

OTHER PUBLICATIONS

U.S. patent application Ser. No. 09/519,474, Kameyama, filed Mar. 2001.
U.S. patent application Ser. No. 09/820,700, Hayashi, filed Mar. 2001.

*Primary Examiner*—Huan Tran
(74) *Attorney, Agent, or Firm*—Oliff & Berridge, PLC

(57) ABSTRACT

An ink sheet cartridge includes a cartridge body 30 rotatably supporting four spools 36, 37, 38, 39. The spool 38 includes a first rotation member 56 having a transmission gear 47 and a shaft member 48 having a flange 48*a*. The first rotation member 46 is undetachably engaged with the shaft member 48 within a support hole 50 formed to the cartridge body 30 while interposing a side plate 51*a* between the transmission gear 47 and the flange 48*a*. An intermediate connector 46 includes resilient pawls 59 and projections 61 for engaging respective mating grooves 60 and locking grooves 62 formed to a takeup-side core tube 41, and is engaged with the flange 48*a* of the shaft member 48.

32 Claims, 34 Drawing Sheets

U.S. PATENT DOCUMENTS

| | | | | |
|---|---|---|---|---|
| 5,110,228 | A | 5/1992 | Yokomizo | |
| 5,374,007 | A | 12/1994 | Murison | |
| 5,378,072 | A | 1/1995 | Gunderson | |
| 5,415,486 | A | 5/1995 | Wouters et al. | |
| 5,455,617 | A | 10/1995 | Stephenson et al. | |
| 5,547,298 | A | 8/1996 | Wouters et al. | |
| 5,690,439 | A | 11/1997 | Sasaki et al. | |
| 5,741,080 | A | 4/1998 | Tomoda et al. | |
| 5,800,084 | A | 9/1998 | Sawada et al. | |
| 5,897,256 | A | 4/1999 | Kameyama | |
| 5,913,621 | A | 6/1999 | Kameyama et al. | |
| 5,959,652 | A | 9/1999 | Privin | |
| 5,961,229 | A | 10/1999 | Kameyama | |
| 5,967,680 | A | 10/1999 | DeLorme | |
| 5,984,546 | A | 11/1999 | Kameyama | |
| 6,019,529 | A | 2/2000 | Yamamoto et al. | |
| 6,079,886 | A | 6/2000 | Kameyama | |
| 6,257,780 | B1 | 7/2001 | Ito et al. | |
| 6,595,710 | B1 * | 7/2003 | Hayashi | 400/208 |
| 6,621,510 | B1 * | 9/2003 | Hayashi | 347/214 |

FOREIGN PATENT DOCUMENTS

| | | |
|---|---|---|
| EP | 0 679 524 B1 | 3/1998 |
| EP | 0 852 183 | 7/1998 |
| EP | 0 852 184 A1 | 7/1998 |
| EP | 0 931 672 A1 | 7/1999 |
| EP | 0 943 446 A1 | 9/1999 |
| GB | 20314810 A | 1/1998 |
| JP | 61-222772 | 10/1985 |
| JP | 61-213181 | 9/1986 |
| JP | 62-164150 | 7/1987 |
| JP | 02-208080 | 8/1990 |
| JP | 05-069624 | 3/1993 |
| JP | 05-270024 | 10/1993 |
| JP | 05-278284 | 10/1993 |
| JP | 06-155877 | 6/1994 |
| JP | U 6-81749 | 11/1994 |
| JP | 07-032693 | 2/1995 |
| JP | 7-49078 | 11/1995 |
| JP | 08-058199 | 3/1996 |
| JP | 08-058202 | 3/1996 |
| JP | 8-276630 | 10/1996 |
| JP | 09-123574 | 5/1997 |
| JP | A 9-141987 | 6/1997 |
| JP | 10-119376 | 5/1998 |
| JP | 10-193731 | 7/1998 |
| JP | 10-193732 | 7/1998 |
| JP | A 10-329378 | 12/1998 |
| JP | A 10 329378 | 3/1999 |
| JP | 11-188956 | 7/1999 |
| JP | A 11-192756 | 7/1999 |
| JP | A 11-208050 | 8/1999 |
| JP | 11-208050 | 8/1999 |

* cited by examiner

INK SHEET CARTRIDGE AND EXCHANGEABLE INK-SHEET SET MOUNTED ON THE INK SHEET CARTRIDGE

BACKGROUND OF THE INVENTION

1. Field of the invention

The present invention relates to an image forming device, an ink sheet cartridge for use in the image forming device, and an exchangeable ink-sheet set available for the ink sheet cartridge.

2. Related Art

Usually, a thermal printer uses an ink ribbon cartridge for printing an image on a recording sheet in terms of ease of exchange and handling. When the thermal printer is a line printer, an ink ribbon cartridge including a wide ink sheet is used. As disclosed in Japanese Utility Model Application Publication No. HEI-6-81749 and Japanese Patent Application Publication No. HEI-10-193732, this type of conventional ink sheet cartridges include a cartridge body, a supply-side member, a takeup-side member, and an ink sheet wound around the supply-side and takeup-side members. The supply-side and takeup-side members are rotatably supported on the cartridge body and detached from the cartridge body when replacing the ink sheet.

The cartridge body includes a pair of covering portions for covering over the upper and lower sides of the outer peripheral surfaces of the supply-side and takeup-side members. The covering portions have a semi-circular cross-sectional shape. Also, the cartridge body is formed in a frame-like shape so as to define a center space where the ink sheet is exposed. Providing the covering portions to the cartridge body increases rigidity of the cartridge body. However, this arrangement increases production cost.

According to Japanese Patent Application Publication No. HEI-10-193732, when the above-described ink sheet cartridge is accommodated in the image forming device, a thermal head provided to the image forming device is positioned below the center space so as to slidingly contact the lower surface of the ink sheet exposed therefrom. On the other hand, a recording sheet is brought into contact with the upper surface of the exposed portion of the ink sheet. After printing is performed on the recording sheet by the thermal head, the recording sheet is transported along a U-shaped sheet passage extending upwardly. This configuration requires a transport chute at the main body or a cover of the image forming device for separating the recording sheet from the ink sheet, and the attachment position of the transport chute is severely restricted to prevent the transport chute from being an obstacle against exchange of the ink sheet cartridge.

On the other hand, according to Japanese Utility Model Application Publication No. HEI-6-81749, the thermal head is provided in sliding contact with the upper surface of the ink sheet, and the recording sheet is transported into abutment with the lower surface of the ink sheet. After printing is performed, the recording sheet is discharged out of the image forming device at a position below the ink sheet cartridge. A front side of the main body case is provided with a door, through which the ink sheet cartridge is inserted into the main body case. Also, a sheet cassette for accommodating the recording sheets is provided next to a side of the main body case close to the door at a position lower than the ink sheet cartridge. The sheet cassette is detachable from the front portion of the main body case.

However, with this configuration, an additional working space is required in front of the main body case for exchanging the recording sheets and the ink sheet cartridge. Because a space for disposing a control board, which controls operation of the image forming device, is also required in the main body case, the main body case has undesirably a large size. Moreover, when recording sheet jamming occurs, the ink sheet cartridge must be removed from the main body case in order to remove the jammed recording sheet from the lower side of the ink sheet cartridge.

Incidentally, each of the supply-side member and the takeup-side member has a core tube for winding thereon the ink sheet and a pair of spools attached to right and left ends of the core tube. One of the pair of spools is provided with a gear. When assembling the ink sheet cartridge into the image forming device, first the spools are engaged with the corresponding ends of the core tubes, and the core tubes are mounted on the cartridge body case via the spools. Then, the ink sheet cartridge is mounted to the main body of the image forming device such that the gears of the spools are meshed with corresponding gears provided to the main body case. With this configuration, the driving power is transmitted from the main body of the image forming device to the spools via the gears, thereby rotating the core tubes for feeding the ink sheet.

However, there has been a danger that a user may erroneously attach the supply-side and takeup-side members on the cartridge body. For example, the left and the right of the members may be opposite. If the members are erroneously attached to the cartridge body, upper and lower surfaces of an ink sheet will be reversed, so that printing operation becomes inoperative. Also, if the gear is set at erroneous side of the cartridge body, supply of the ink sheet becomes impossible. However, attachment work for attaching the members and spools at correct positions and orientations is bothering and troublesome for a user.

Moreover, an ink sheet having an ink quality different from a regular ink sheet, such as those of different manufacturer, may be accidentally used. When an ink sheet having a width, a dimension, a sheet material, and an ink material different from those of a regular ink sheet is incorporated into the ink sheet cartridge and used in the image forming device, normal printing will be prevented. This will undesirably degrade a quality of recorded images, which should have an excellent image quality otherwise.

The conventional image forming device is also provided with a torque limiter at the power transmission portion of the main body case. The torque limiter enables taking up of the ink sheet with a proper tension, and also prevents excessive tension from being applied to the ink sheet by providing slippage at the power transmitting region when a torque value is exceeded a maximum torque value so as to is reduce power transmission from the main body to the takeup-side member.

The maximum torque value required for taking-up the ink sheet differs in accordance with a thickness, a width, and a material of the ink sheet. However, because the torque limiter is provided to the main body case of the image forming device, it is difficult and troublesome to change the maximum torque value each time and every time a different ink sheet is used.

There has been also provided a torque transmission mechanism where one end of each core tube is formed with a notched groove open to the one end, and one of the pair of spools is provided with an engagement projection engageable with the notched groove. With this configuration, torque is transmitted to the core tubes for taking up the ink sheet with a proper tension, and the torque limiter provided to the main body case of the image forming device can be dispensed with.

However, because the maximum torque value differs in accordance with the ink sheet as described above, a dimension of inner and outer diameters of the core tube where the ink sheet is wound around also differs. Accordingly, each time when a different type of ink sheet is used, spools having a corresponding diameter are needed. This causes increase in production cost.

SUMMARY OF THE INVENTION

It is therefore an objective of the present invention to overcome the above-described drawbacks, and to provide an ink sheet cartridge and an exchangeable ink-sheet set used in the ink sheet cartridge enabling a user to easily exchange the ink-sheet set and preventing assembly of ink sheet sets other than regular ink-sheet sets.

It is another objective of the present invention to provide an ink sheet cartridge and an exchangeable ink-sheet set available for the ink sheet cartridge capable of providing an optimum transmission torque in accordance with a thickness, a width, and a material of the ink sheet to be used.

In order to achieve the above and other objectives, there is provided

There is also provided an ink sheet cartridge including four spools, a cartridge body that rotatably supports the four spools, an intermediate connector having a substantially-cylindrical shape and detachably connected to one of the four spools and unconnected to remaining three of the four spools, a supply-side core tube having two ends opposite from each other, a takeup-side core tube having two ends opposite from each other, and an ink sheet wound around and expanding between the supply-side core tube and the takeup-side core tube. The intermediate connector and the remaining three of the four spools are detachably engaged with the corresponding ends of the supply-side core tube and the takeup-side core tube.

There is also provided and ink sheet cartridge including four spools, a cartridge body that rotatably supports the four spools, a supply-side core tube having two ends opposite from each other, a takeup-side core tube having two ends opposite from each other, and an ink sheet wound around and expanding between the supply-side core tube and the takeup-side core tube. The four spools are detachably engaged with the corresponding ends of the supply-side core tube and the takeup-side core tube, and one of the four spools has an engagement pawl, and one or the supply-side core tube and the takeup-side core tube is provided with an engagement member for engageing the engagement pawl.

There is also provided an ink sheet set detachably mountable on an ink sheet cartridge including four spools, a cartridge body freely rotatably supporting the four spools, and an intermediate connector having a substantially-cylindrical shape and connected to one of the four spools and unconnected to remaining three of the four spools. The ink sheet set includes a supply-side core tube having two ends opposite from each other, a takeup-side core tube having two ends opposite from each other, and an ink sheet wound around and expanding between the supply-side core tube and the takeup-side core tube. Each of the ends of the supply-side core tube and the takeup-side core tube is detachably engageable with corresponding one of the intermediate connector and the remaining three of the four spools.

There is also provided an ink sheet set detachably mountable on an ink sheet cartridge including four spools and a cartridge body rotatably supporting the four spools, one of the four spools having an engagement pawl. The ink sheet set includes a supply-side core tube having two ends opposite from each other, a takeup-side core tube having two ends opposite from each other, and an ink sheet wound around and expanding between the supply-side core tube and the takeup-side core tube. Each of the ends of the supply-side core tube and the takeup-side core tube detachably engages corresponding one of the four spools, and one of the supply-side core tube and the takeup-side core tube is provided with an engagement member for engaging the engagement pawl.

There is also provided an ink sheet set detachably mountable on an ink sheet cartridge including four spools and a cartridge body freely rotatably supporting the four spools. The ink sheet set includes a supply-side core tube having two ends opposite from each other, a takeup-side core tube having two ends opposite from each other, an ink sheet wound around and expanding between the supply-side core tube and the takeup-side core tube, and an intermediate connector having a substantially-cylindrical shape. The intermediate connector is detachably engaged with one of the ends of the supply-side core tube and the takeup-side core tube and unengaged with remaining three of the ends of the supply-side core tube and takeup-side core tube. The intermediate connector and the remaining three of the ends are engageable with corresponding ones of the four spools.

There is also provided an intermediate connector for use in an ink sheet cartridge of an image forming device, the ink sheet cartridge including four spools each having an outer diameter portion, a cartridge body freely rotatably supporting the four spools, a pair of core tubes each having two ends and an inner diameter portion, and an ink sheet wound around and expanding between the pair of care tubes. The intermediate connector includes a body having a substantially-cylindrical shape having a first portion that is insertable into the inner diameter portion of one of the pair of core tubes and a second portion integrally formed with the first portion. The second portion has an inner diameter portion receivable the outer diameter portion of one of the four spools, thereby connecting the one of the four spools with the one of the pair of core tubes.

There is also provided a cartridge set used in an ink sheet cartridge of an image forming device, the ink sheet cartridge including four spools and a cartridge body freely rotatably supporting the four spools. The cartridge set includes a takeup-side core tube having two ends opposite from each other, and an intermediate connector having a substantially-cylindrical shape. The intermediate connector connects one of the two ends of the takeup-side core tube and one of the four spools.

There is also provide a core tube used in an ink sheet cartridge of an image forming device, and ink sheet cartridge including four spools, a cartridge body rotatably supporting the four spools, and an intermediate connector detachably connected to one of the four spools. The core tube includes a body having a cylindrical shape with two ends opposite from each other. One of the two ends is engageable with the intermediate connector.

There is also provided a core tube detachably mountable on an ink sheet cartridge including four spools and a cartridge body rotatably supporting the four spools, one of the four spools having an engagement pawl. The core tube includes a cylindrical body having two ends opposite from each other. One of the two ends is detachably engageable with the one of the four spools. The cylindrical body includes an engagement member for engaging the engagement pawl.

There is provided an ink sheet set including a supply-side core tube having two ends opposite from each other, a takeup-side core tube having two ends opposite from each other, an ink sheet wound around and expanding between the supply-side core tube and the takeup-side core tube, and an intermediate connector having a substantially-cylindrical shape, the intermediate connector being engaged with one of the ends of the supply-side care tube and the takeup-side core tube.

There is provided an intermediate connector for use in an ink sheet set including a pair of core tubes each having two ends and an inner diameter portion, and an ink sheet wound around and expanding between the pair of core tubes. The intermediate connector includes a body having a substantially-cylindrical shape having a first portion that is insertable into the inner diameter portion of one of the pair of core tubes and a second portion integrally formed with the first portion.

There is provided a core tube used in an ink sheet set including an intermediate connector and an ink sheet. The core tube includes a body having a cylindrical shape with two ends opposite from each other. One of the two ends is engageable with the intermediate connector.

There is provided a core tube used in an ink sheet cartridge. The core tube includes a cylindrical body having two ends detachably engageable with a specific spool having an engagement pawl. The cylindrical body includes an engagement member for engaging the engagement pawl.

There is provided an ink sheet cartridge including at least three spools, a cartridge body that rotatably supports the spools, an intermediate connector having a substantially-cylindrical shape and detachably connected to one of the at least three spools and unconnected to remaining spools of the at least three spools, a supply-side core tube having two ends opposite from each other, a takeup-side core tube having two ends opposite from each other, and an ink sheet wound around and expanding between the supply-side core tube and the takeup-side core tube. The intermediate connector and the remaining spools of the at least three spools are detachably engaged with the corresponding ends of the supply-side core tube and the takeup-side core tube.

There is provided an ink sheet cartridge including a tube-like supply-side member having two ends opposite from each other, a shaft being provided at the two ends respectively, a tube-like takeup-side member having two ends opposite from each other, a shaft being provided at one end, an intermediate connector having a substantially-cylindrical shape and detachably connected to the other end of the tube-like takeup-side member, a specific spool detachably engageable to the intermediate connector, the specific spool having a shaft, a cartridge body that rotatably supports the shafts, and an ink sheet wound around and expanding between the tube-like supply-side member and the tube-like takeup-side member.

There is provided an ink sheet cartridge including a tube-like supply-side member having two ends at which a shaft being provided at the two ends respectively, a tube-like is takeup-side member having two ends opposite from each other, a shaft being provided at one end and an engageable member being provided at the other end, a specific spool detachably engageable to the other end of the tube-like takeup-side member, the specific spool having a shaft and an engageable pawl opposite to the shaft, the enagageable pawl being engageable with the engageable member of the tube-like takeup-side member, a cartridge body that rotatably supports the shafts, and an ink sheet wound around and expanding between the tube-like supply-side member and the tube-like takeup-side member.

There is provided an ink sheet cartridge including a supply-side core tube having two ends, a takeup-side core tube having two ends, at least two spools that includes a specific spool having an engagement pawl, each spools being detachably engageable with corresponding core tube respectively, and a cartridge body that rotatably supports the spools, an ink sheet wound around and expanding between the supply-side core tube and the takeup-side core tube. One of the supply-side core tube and takeup-side core tube includes an engagement member for engaging the engagement pawl of the specific spool.

BRIEF DESCRIPTION OF THE DRAWINGS

FIG. 10(*c*) is a left side view of the first rotation member;

FIG. 10(*d*) is a right side view of the first rotation member;

FIG. 11(*b*) is a cross-sectional view of the shaft member taken along the line XIb—XIb of FIG. 11(*a*);

FIG. 11(*c*) is a right side view of the shaft member;

FIG. 11(*d*) is a perspective view of the shaft member;

FIG. 11(*e*) is a perspective view of the shaft member;

FIG. 12(*b*) is a front view showing the intermediate connector and an end portion of a core tube;

FIG. 12(*c*) is a bottom view showing the intermediate connector;

FIG. 12(*d*) is a rear view showing the intermediate connector;

FIG. 12(*e*) is a top view showing the intermediate connector;

FIG. 13(*b*) is a cross-sectional view of the intermediate connector taken along the line XIIIb—XIIIb of FIG. 13(*a*);

FIG. 13(*c*) is a left side view of the intermediate connector;

FIG. 13(*d*) is a right side view of the intermediate connector;

FIG. 14(*b*) is an enlarged cross-sectional view showing the complete assemble of the first rotation member, the shaft member, the intermediate connector, and the core tube;

FIG. 18(*b*) is a cross-sectional view of the takeup-side core tube taken along the line XVIIIb—XVIIIb of FIG. 18(*b*);

FIG. 18(*c*) is an enlarged cross-sectional view showing the complete assemble of the first rotation member, the shaft member, and the takeup-side core tube of FIG. 16;

FIG. 19(*b*) is a cross-sectional partial view of the ink sheet cartridge taken along a line XIXb—XIXb of FIG. 19(*a*);

FIG. 23(*b*) is a partially cross-sectional view of the intermediate connector of FIG. 23(*a*);

FIG. 33(*b*) is a front view of the takeup-side core tube;

FIG. 33(*c*) is a left side view of the takeup-side core tube;

FIG. 33(*d*) is a right side view of the takeup-side core tube;

FIG. 33(*e*) is a rear view of the takekup-side core tube;

FIG. 33(*f*) is a bottom view of the takeup-side core tube;

FIG. 33(*g*) is a cross-sectional view of the takeup-side core tube taken along a line XXXIIIg—XXXIIIg of FIG. 33(*c*);

FIG. 33(*h*) is a perspective view showing the left side end of the takeup-side core tube;

FIG. 33(*i*) is a top view of the takeup-side core tube in engagement with a resilient pawl;

FIG. 34(*b*) is a front view of the cartridge body of FIG. 34(*a*);

FIG. 34(*c*) is a left side view of the cartridge body of FIG. 34(*a*);

FIG. 34(*d*) is a right side view of the cartridge body of FIG. 34(*a*);

FIG. 34(*e*) is a rear view of the cartridge body of FIG. 34(*a*);

FIG. 34(*f*) is a bottom view of the cartridge body of FIG. 34(*a*);

FIG. 34(*g*) is a perspective view of the takeup-side left spool supported on the cartridge body of FIG. 34(*a*);

FIG. 34(*h*) is a cross-sectional view taken along a line XXXIVh—XXXIVh of FIG. 34(*a*); and FIG. 34(*i*) is a cross sectional view of the takeup-side spool of FIG. 34(*g*) taken along a line XXXIVi—XXXIVi.

PREFERRED EMBODIMENTS OF THE PRESENT INVENTION

Next, a facsimile device and ink sheet cartridges according to preferred embodiments of the present invention will be described in detail with reference to drawings.

First, a facsimile device 1 shown in FIG. 1 will be described. The facsimile device 1 includes ordinary facsimile functions including a function for reading an image from an original 8 and transmits its image data as facsimile data to another facsimile device through a transmission line, such as a telephone line, and a function for receiving facsimile data transmitted from other facsimile device through the transmission line and forming an image on a recording sheet 4 based on the facsimile data. In addition, the facsimile device 1 also includes a printer function for forming an image based on print data transmitted via a printer cable or radio beam, such as infrared rays, from a personal computer and a word processor.

Figure 1:
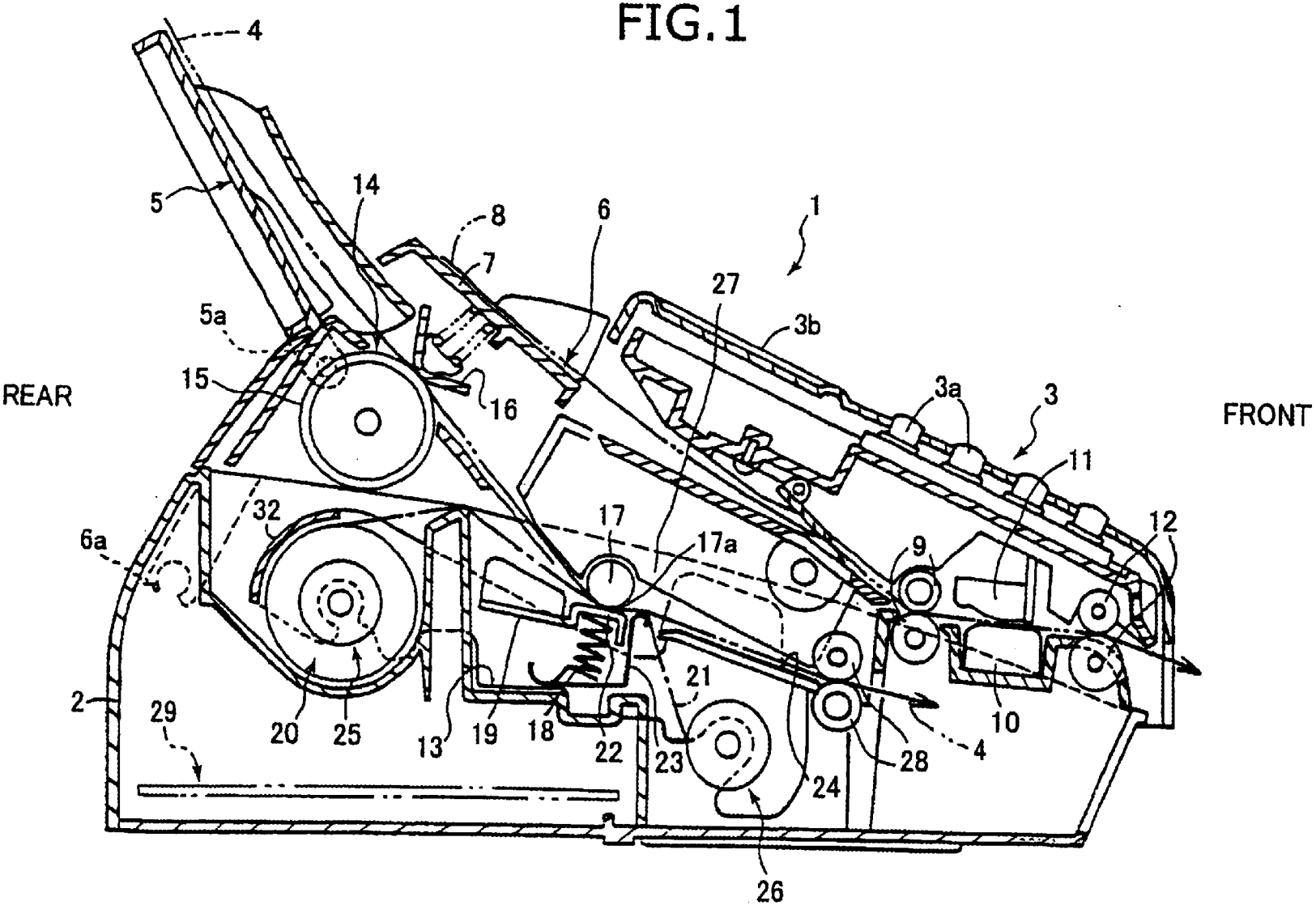
FIG. 1 is a cross-sectional side view showing a facsimile device in which an ink sheet cartridge of the present invention is used.

As shown in FIG. 1, the facsimile device 1 includes a main body case 2, an upper cover 6, an operation panel 3, a sheet feed stand 5, and an original stand 7. Although not shown in the drawings, a handset is provided on one side of the main body case 2. The main body case 2 has an upper opening. The upper cover 6 is positioned to cover the upper opening of the main body case 2. A pivot point 6*a* is provided at an upper rear end of the main body case 2, so that the upper cover 6 is pivotally movable in a vertical direction about the pivot point 6*a* at a rear end of the upper cover 6. The operation panel 3 is provided to an upper front portion of the upper cover 6, and includes key switches 3*a* and a liquid crystal display 3*b*. The operation panel 3 is also pivotally movable about its rear end such that its front end is moved upwardly in order to remove the original 8 jammed thereat, for example. The sheet feed stand 5 is provided at the upper rear portion of the main body case 2, and is pivotally movable about a pivot point 5*a* at the rear end of the upper cover 6. The paper feed stand 5 mounts thereon a stack of recording sheets 4 in a slanted orientation such that leading ends of the recording sheets 4 are positioned lower than the trailing ends thereof. The original stand 7 is detachably provided at an upper intermediate portion between the front and rear ends of the main body case 2.

In the main body case 2, there are provided below the operation panel 3 a pair of feed rollers 9, a contact type image scanner portion (CIS) 10, an original holder 11, and a pair of original discharge rollers 12. The feed rollers 9 transfer the original 8 from the original stand 7. The original holder 11 is positioned above a reading portion of the CIS 10.

In the main body case 2, there are also provided a sheet feed portion 14 at a position below the sheet feed stand 5. The sheet feed portion 14 includes a sheet supply roller 15 and a separation pad 16. The sheet supply roller 15 transports each one of the recording sheets 4 from the sheet feed stand 5. The separation pad 16 is urged against an upper peripheral surface of the sheet feed roller 15.

Below the sheet feed portion 14, there are provided a roller shaped platen 17, a spring 18, a print stand 19, a thermal head 22, an accommodating portion 13, and a tension member 23. The thermal head 22 is a line printer having a heat generating register that generates heat when applied with electric current in accordance with image data. The thermal head 22 is positioned, while facing its recording surface upward, on the print stand 19. The print stand 19 is urged toward a lower surface of the platen 17 by the spring 18. Accordingly, the thermal bead 22 is urged to contact the recording surface of the platen 17, thereby defining a print portion 17*a* between the thermal head 22 and the platen 17. The accommodating portion 13 accommodates therein an ink sheet cartridge 20 in such a manner that the cartridge 20 exceeds the front and rear ends of the print stand 19. The tension member 23 is made of a spring like plate segment.

Incidentally, the upper cover 6 is formed with a plurality of rib like upper chute portions 27 extending from rear to front over the platen 17 and downwardly protruding from the lower surface of the upper cover 6.

Figure 3:
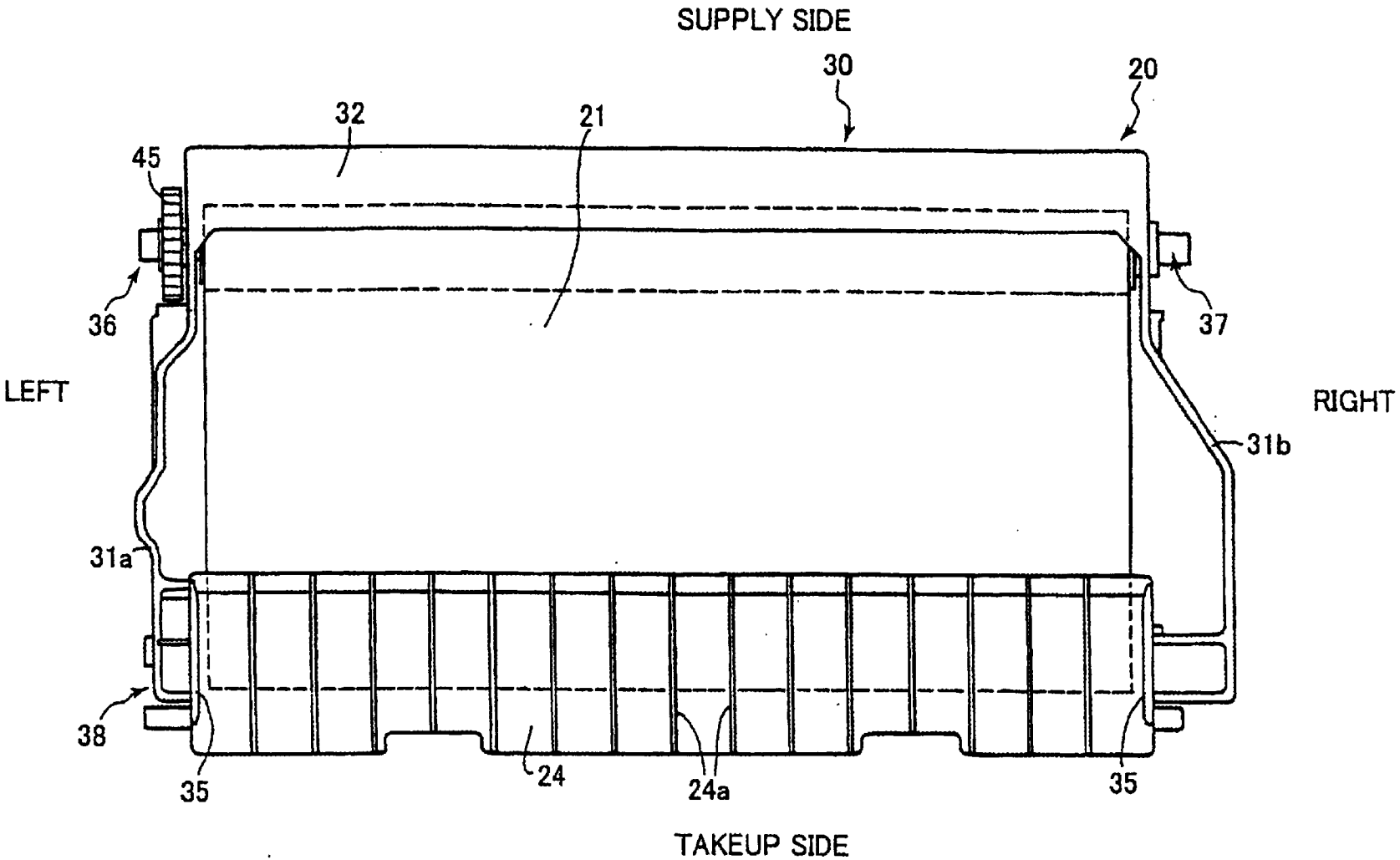
FIG. 3 is a plan view showing an ink sheet cartridge according to a first embodiment of the present invention.
Figure 4:
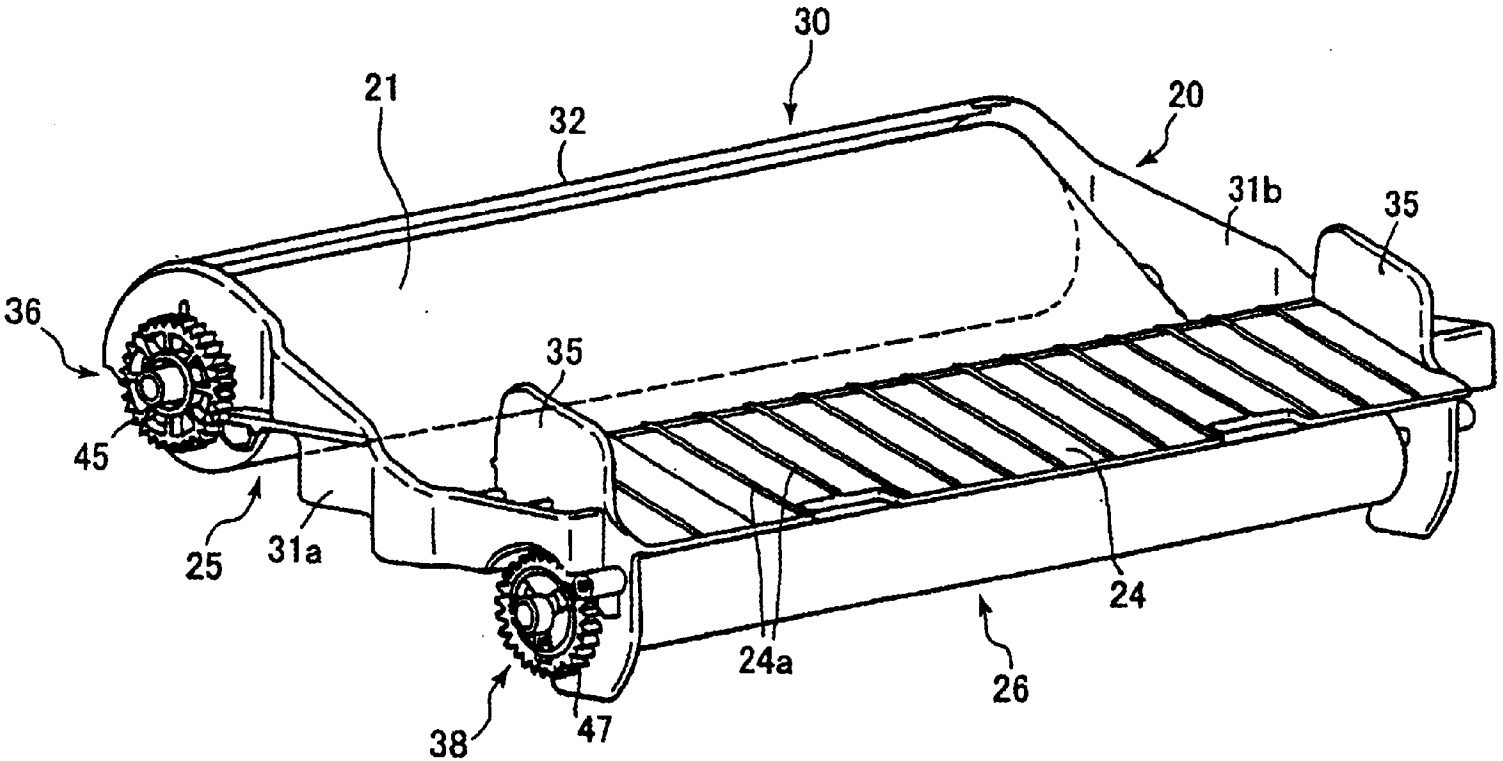
FIG. 4 is a perspective view showing the ink sheet cartridge of FIG. 3 as viewed from a front left side thereof.
Figure 5:
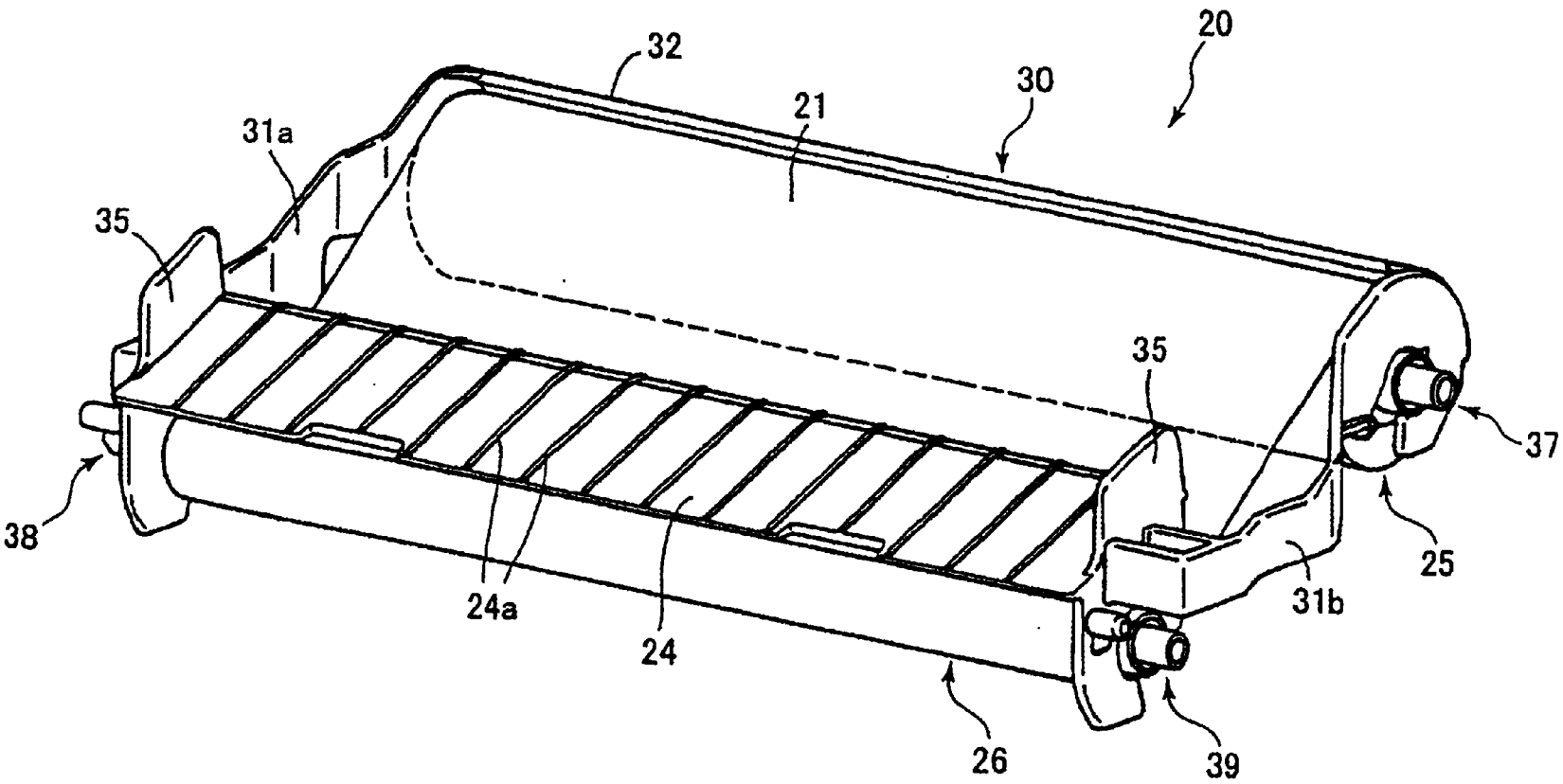
FIG. 5 is a perspective view showing the ink sheet cartridge as viewed from a front right side thereof.
Figure 6:
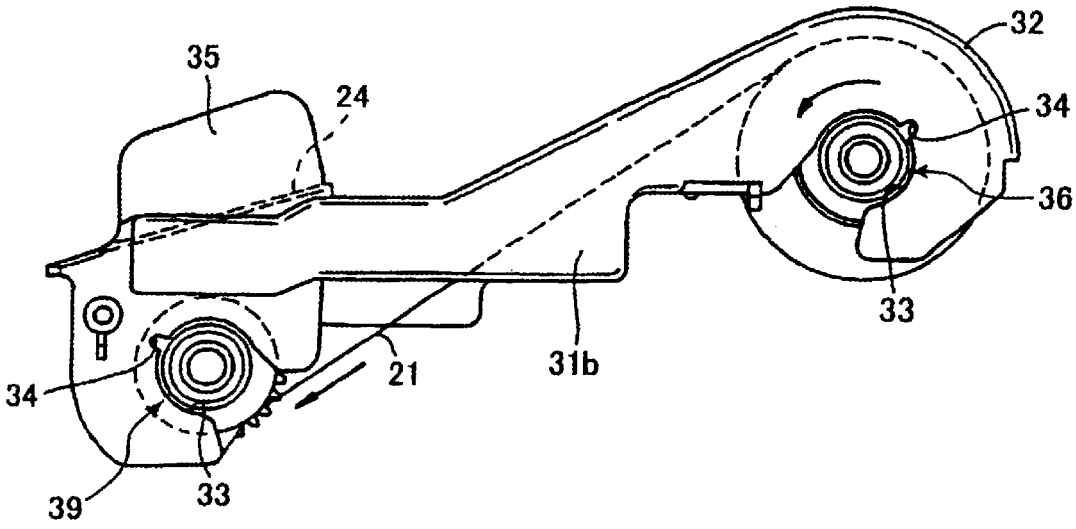
FIG. 6 is a right side view showing the ink sheet cartridge.
Figure 7:
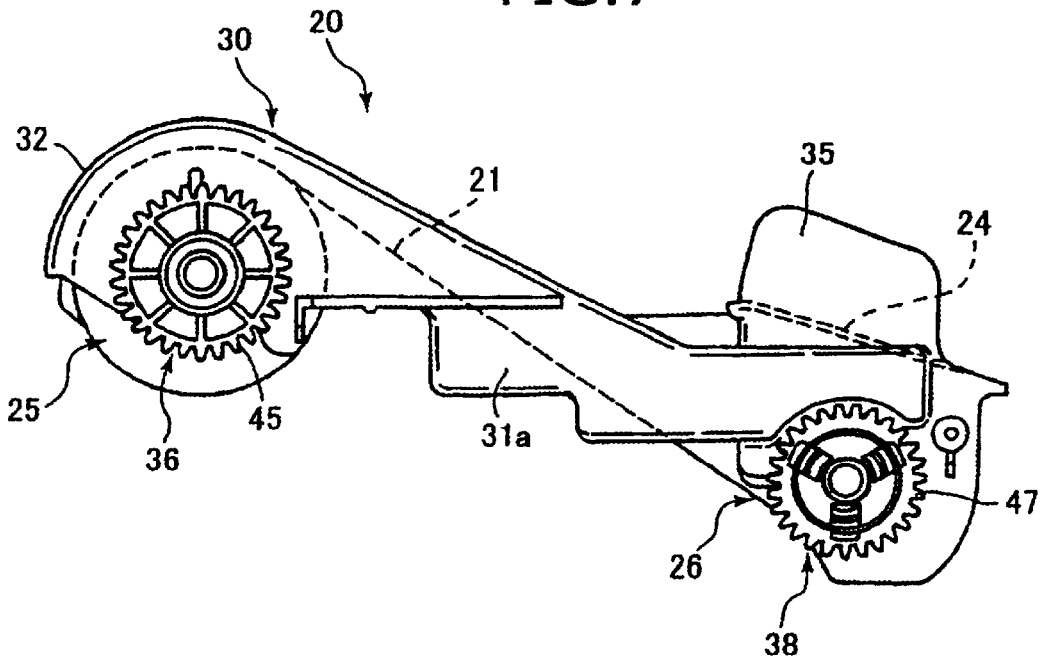
FIG. 7 is a left side view showing the ink sheet cartridge.

Next, the ink sheet cartridge 20 will be described. As shown in FIGS. 3 to 5, the ink sheet cartridge 20 includes a cartridge body 30, a supply side member 25, a takeup side member 26, and an ink sheet 21. The cartridge body 30 includes a partitioning plate 24. The ink sheet 21 is wound around and extending between the supply side member 25 and the takeup side member 26. The ink sheet 21 has an ink surface on which an ink layer is formed.

Figure 2:
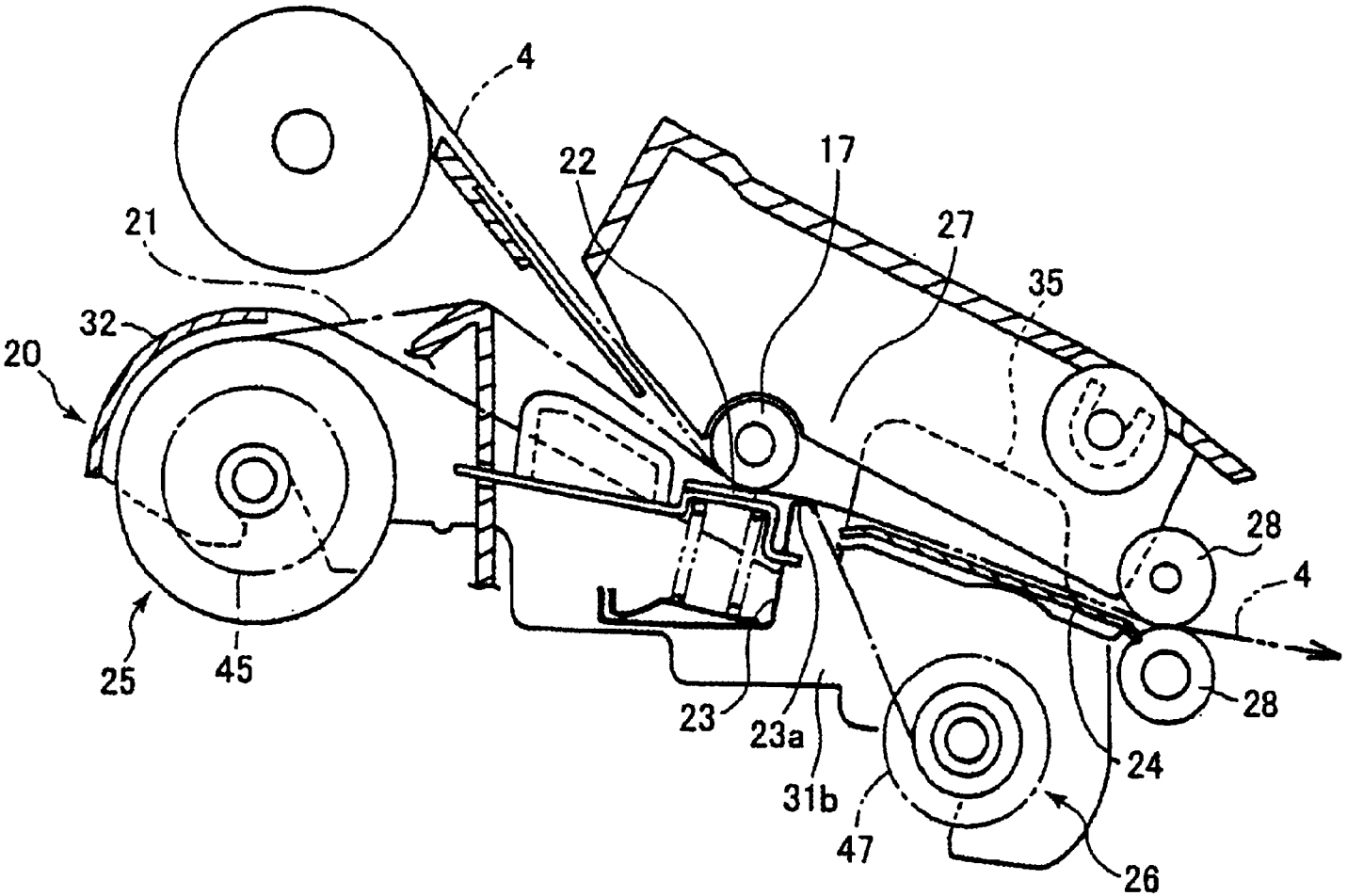
FIG. 2 is a cross-sectional partial side showing an ink sheet passage and a recording sheet passage near a printing portion of the facsimile device of FIG. 1.

When the ink sheet cartridge 20 is assembled in the accommodating portion 13 of the main body case 2, the supply side member 25 is positioned at the rear side of the main body case 2, and the takeup side member 26 is positioned at the front side thereof at a position lower than the supply side member 25, thereby providing a front-low rear-high orientation (hip-up orientation) of the ink sheet cartridge 20. With this configuration, a relatively large space is defined at the lower rear portion of the main body case 2 below the accommodating portion 13. In this large space, a control baseboard 29 for executing various operation of the facsimile device 1 is positioned. As shown in FIG. 1, the partitioning plate 24 is disposed above the takeup side member 26. The partitioning plate 24 and the upper chute portions 27 together serve as a transporting chute. Also, the ink sheet 21 of the ink sheet cartridge 20 extends over the thermal head 22 and a top 23*a* of the tension member 23 as shown in FIG. 2, while facing the ink surface upward.

For printing, the recording sheet 4 is brought overlapped with the ink surface of the ink sheet 21. Then, both the recording sheet 4 and the ink sheet 21 are nipped at the print portion 17*a*, and an image is formed on the recording sheet 4 by the thermal head 22. Then, the recording sheet 4 is fed alone between the upper chute portions 27 and an upper surface of the partitioning plate 24. Then, the recording sheet 4 is discharged out of the main body case 2 via a pair of sheet discharge rollers 28.

On the other hand, the ink sheet 21 is bent downwardly at the top 23*a* of the tension member 23 and separated from the recording sheet 4. Then, the ink sheet 21 passes below the partitioning plate 24 and reaches the lower peripheral surface of the takeup side member 26 for being winding thereover.

Figure 8:
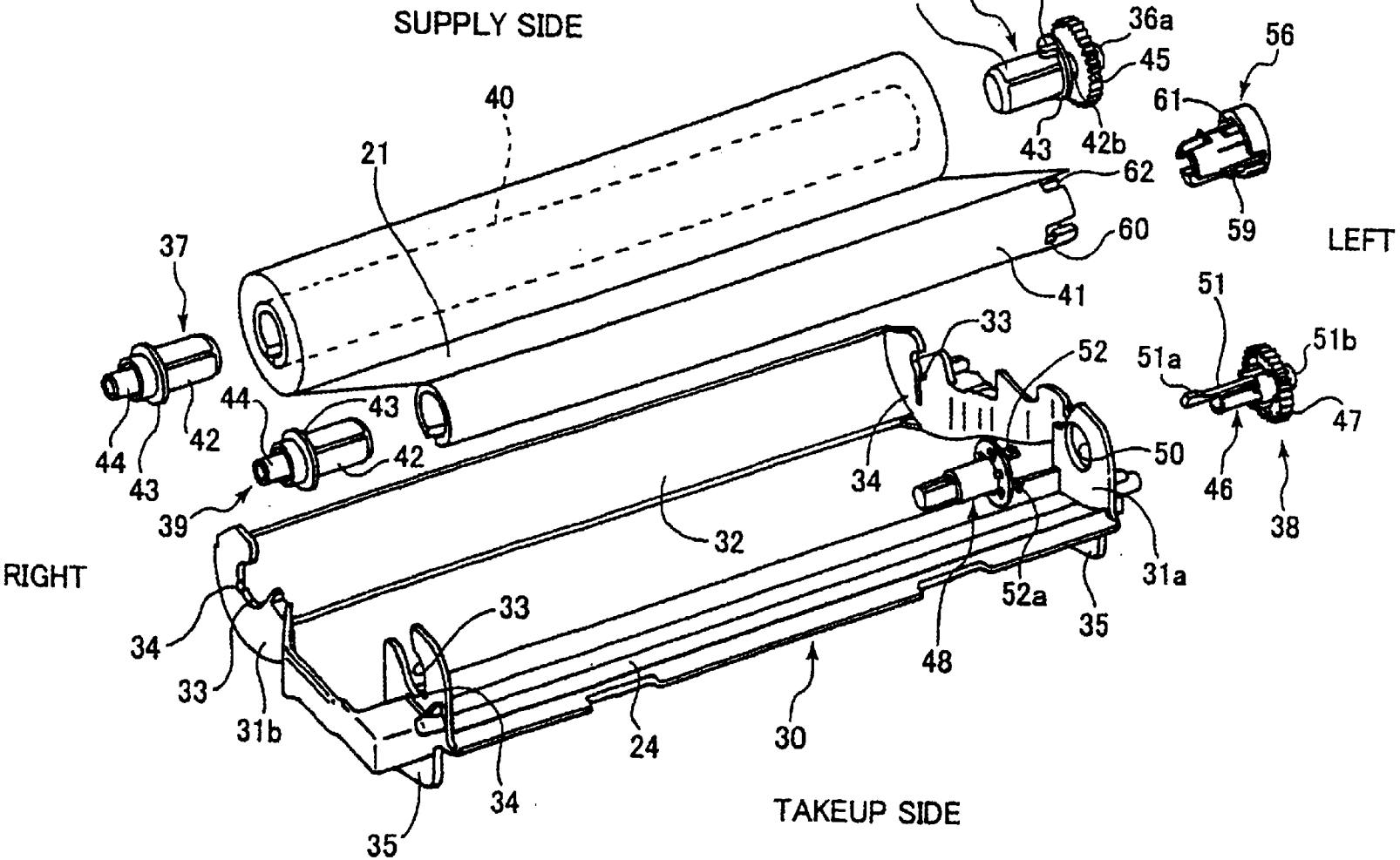
FIG. 8 is an exploded perspective view showing components of the ink sheet cartridge where the ink sheet cartridge is turned upside down.

Details of the ink sheet cartridge 20 will be described further with reference to FIGS. 3 through 11. As shown in FIGS. 5 and 8, the supply side member 25 includes a left spool 36, a right spool 37, and a cylindrical core tube 40. Also, the takeup side member 26 includes a left spool 38, an intermediate connector 56, a right spool 39, and a cylindrical core tube 41. The ink sheet 21 includes a wide resin film having the ink surface, and is wound around the core tubes 40, 41. The core tubes 40, 41 are formed of a rigid paper. The spools 36, 37 are detachably insertable into left and right ends of the core tube 40. The spool 39 is detachably insertable into right end of the core tube 41.

The spools 36, 37, 39 are formed from a synthetic resin by injection molding technique. As shown in FIG. 8, the spools 37, 39 include a shaft 44 integrally formed with a flange 43. The spool 36 includes a shaft 42*b* integrally formed with a flange 43. The remaining spool 38 is a composite member including a plurality of components. Details will be described later.

As shown in FIGS. 3 to 5, the cartridge body 30 includes a pair of left and right side plates 31*a*, 31*b*, an upper cover segment 32, and the partitioning plate 24, all integrally formed with each other from a synthetic resin by injection molding. The left and right side plates 31*a*, 31*b* extend from the supply side to the takeup side, and are positioned beside the left and right edges of the ink sheet 21. The upper cover segment 32 is bridged between the left and right side plates 31*a* and 31*b*, and covers over an upper area of the supply-side sheet roll. The partitioning plate 24 is bridged between the left and right side plates 31*a* and 31*b*, and covers an upper area of the takeup-side sheet roll. The upper surface of the partitioning plate 24 is formed with a plurality of rib-like projections 24*a* protruding upwardly. With this configuration, the upper cover segment 32, the partitioning plate 24, and the left and right side plates 31*a*, 31*b* define an open area among them where the ink sheet 21 is exposed. Although the cartridge body 30 has the above-described simple configuration, because the partitioning plate 24 has a function to connect together the left and right side plates 31*a*, 31*b*, the partitioning plate 24 maintains the rigidity of the cartridge body 30.

With this configuration, as shown in FIGS. 1 and 2, when the ink sheet cartridge 20 is accommodated in the accommodating portion 13 of the main body case 2, the platen 17 is positioned above the open area, whereas the print stand 19, the thermal head 22, and the tension member 23 are positioned below the open area.

As shown in FIGS. 3 to 5, fin like knob portions 35, 35 protrude upwardly from left and right sides of the partitioning plate 24 so that the user can hold the ink sheet cartridge 20 by the knob protrusions 35, 35. That is, when removing the ink sheet cartridge 20 from the accommodating portion 13, a user can easily lift up the ink sheet cartridge 20 from the main body case 2 by holding the knob portions 35, 35 with his or her fingers. Therefore, the user can easily exchange the ink sheet 21. Also, because the user can hold the knob portions 35, 35 without directly touching the ink sheet 21, user's hands will not be dirtied by the ink. It should be noted that these fin like knob portions 35, 35 can protrude upwardly from the left and right side plates 31*a*, 31*b* instead.

As shown in FIG. 8, the right side plate 31*b* is formed with a pair of shaft support grooves 33 at its supply side and takeup side for rotatably supporting the shafts 44 of corresponding ones of the right spool 37 and the right spool 39. The left side plate 31*a* is formed with a shaft support groove 33 at its supply side for rotatably supporting the shaft 42*b* of the left spool 36, and a shaft hole 50 at its takeup side for rotatably supporting the left spool 38. Each shaft support groove 33 is formed with an open portion at its lower portion, through which the shaft 44, 42*b* of the corresponding spool 36, 37, 39 is forcibly pushed into the shaft support groove 33.

Also, each shaft support groove 33 is in communication with a slit like relief groove 34 extending radially outwardly from each shaft support groove 33. When the shafts 44, 42*b* are pushed into the respective shaft support grooves 33, the open portions of the shaft support grooves 33 resiliently expand because of the relief grooves 34. Upon complete insertion of the shafts 44, 42*b* into the shaft support grooves 33, the open portions restore their original shape to prevent the shafts 44, 42*b* from being disengaged from the shaft support grooves 33.

As shown in FIG. 8, the spools 37, 39 have a configuration identical with each other. Each of the spools 37, 39 includes an inner sleeve 42, the flange 43, and the cylindrical shaft 44. The inner sleeve 42 is engageable with a right end inner peripheral surface of corresponding one of the supply-side core tube 40 and the takeup-side core tube 41. The flange 43 has a diameter greater than that of the inner sleeve 42, and the shaft 44 has a diameter smaller than that of the inner sleeve 42.

The supply-side left spool 36 includes an inner sleeve 42, the shaft 42*b*, the large diameter flange 43, and a gear wheel 45. The inner sleeve 42 is engageable with a left-side inner-peripheral surface of the supply-side core tube 40. The inner sleeve 42 has an engaging pawl 42*a* for engaging a notched groove (not shown) formed in the core tube 40. The shaft 42*b* is positioned outwardly of the flange 43, and the gear wheel 45 is positioned outwardly of the shaft 42*b*. The shaft 42*b* is positioned between the flange 43 and the gear wheel 45.

Figure 9:
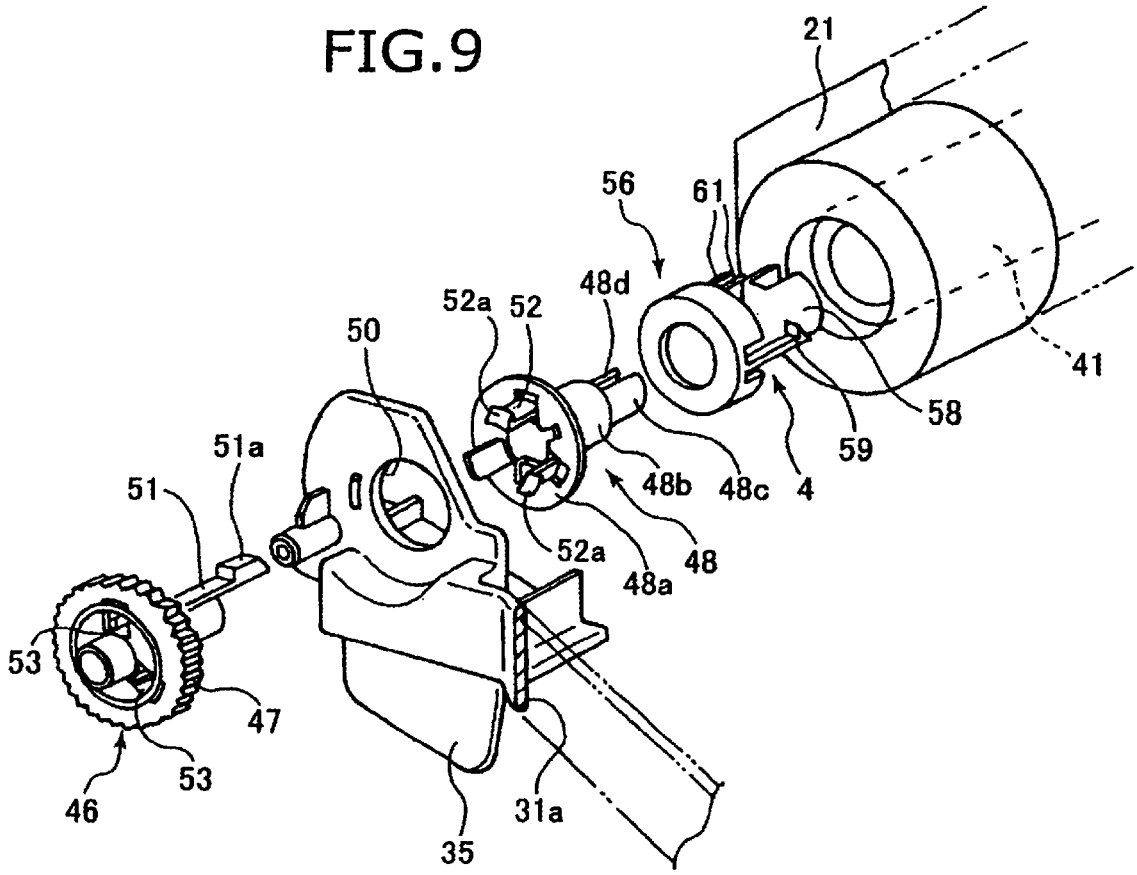
FIG. 9 is an exploded perspective view of a takeup-side left spool.
Figure 10A:
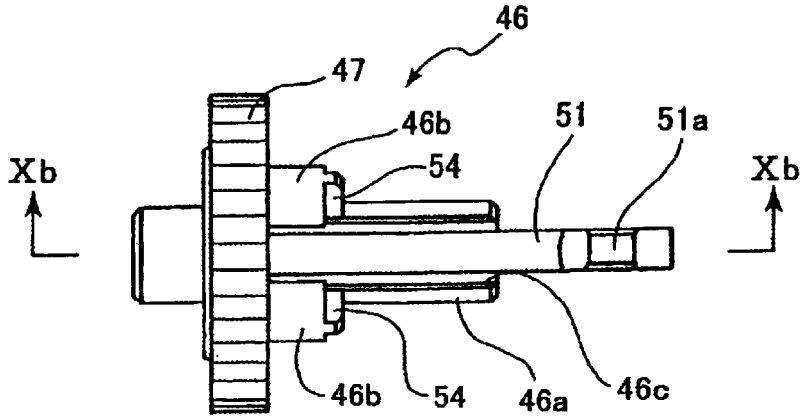
FIG. 10(*a*) is a front view showing the a first rotation member of the takeup-side left spool of FIG. 9, FIG. 10(*b*) is a cross-sectional view of the first rotation member taken along the line Xb—Xb in FIG. 10(*a*)
Figure 10B:
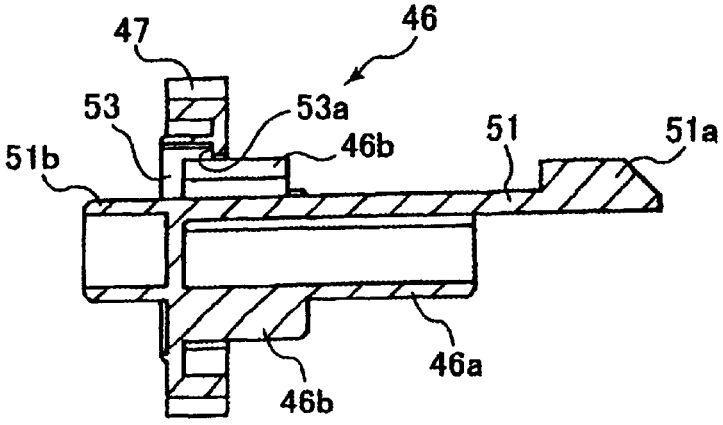
Figure 10C:
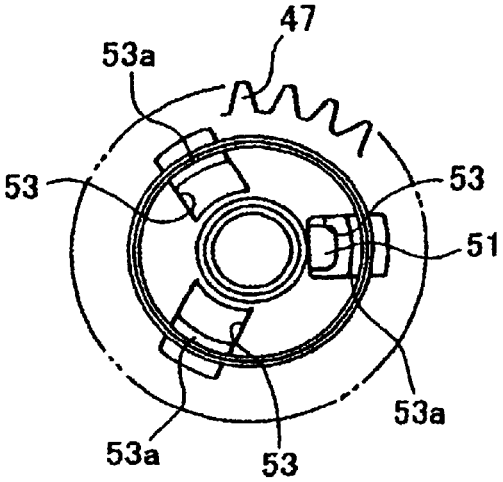
Figure 10D:
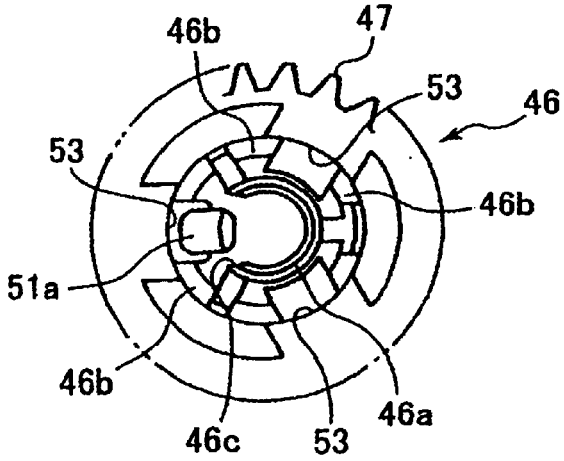
Figure 11A:
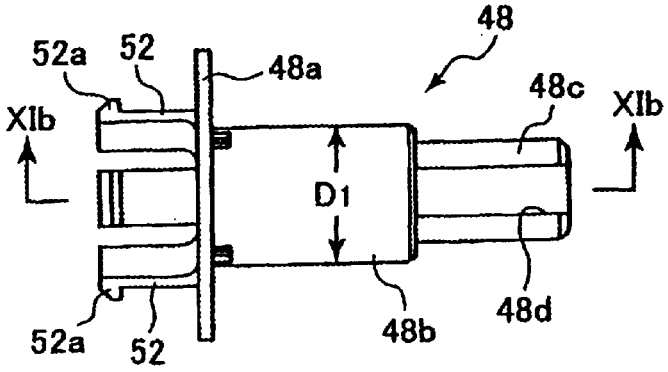
FIG. 11(*a*) is front view showing a shaft member of the takeup-side left spool of FIG. 9.
Figure 11B:
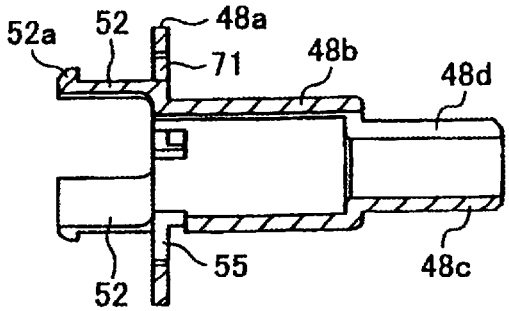
Figure 11C:
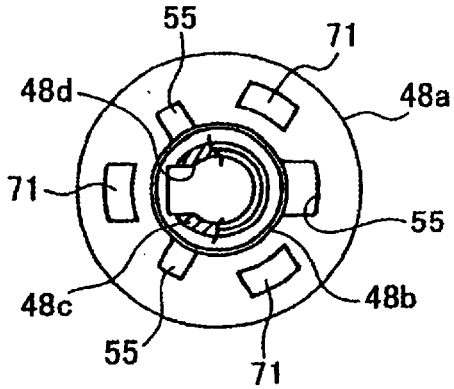
Figure 11D:
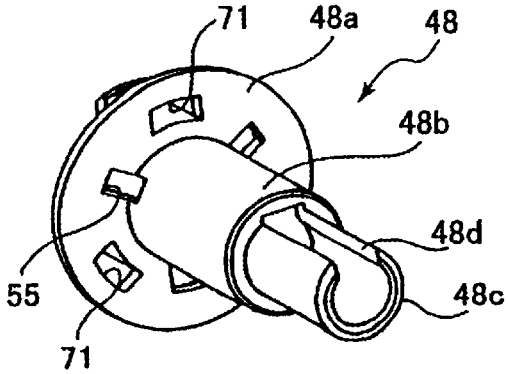
Figure 11E:
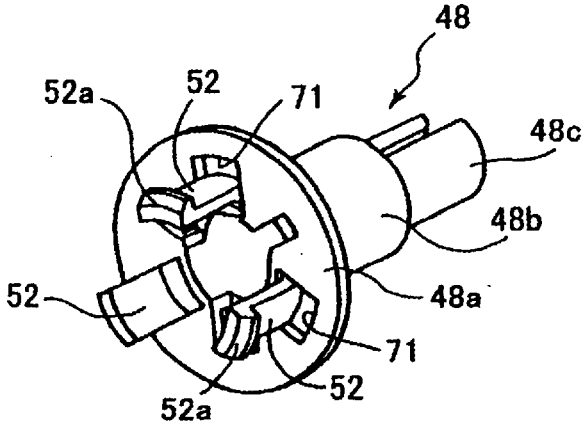
Figure 12A:
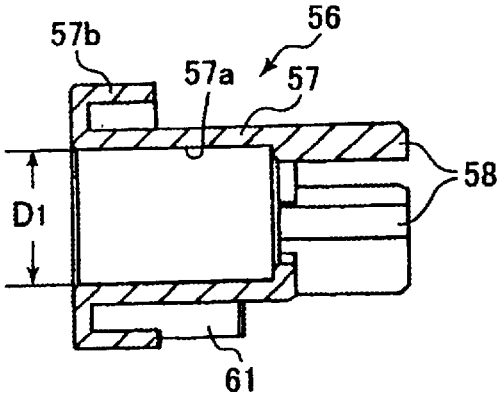
FIG. 12(*a*) is a cross-sectional view showing an intermediate connector of the takeup-side left spool of FIG. 9 taken along a line XIIa—XIIa of FIG. 12(*e*)
Figure 12B:
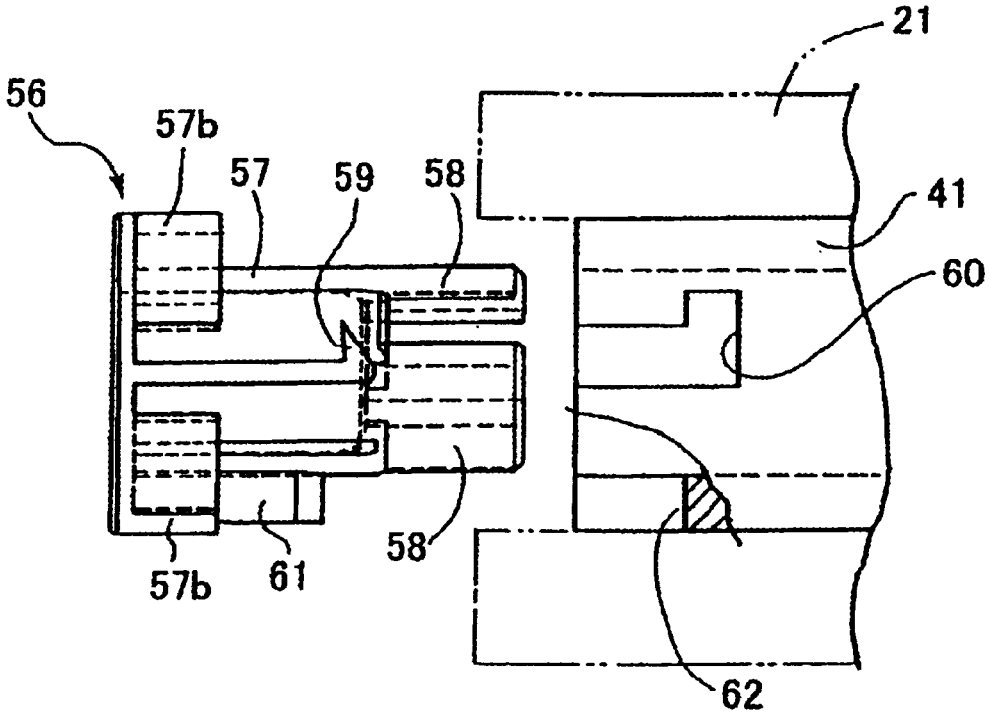
Figure 12C:
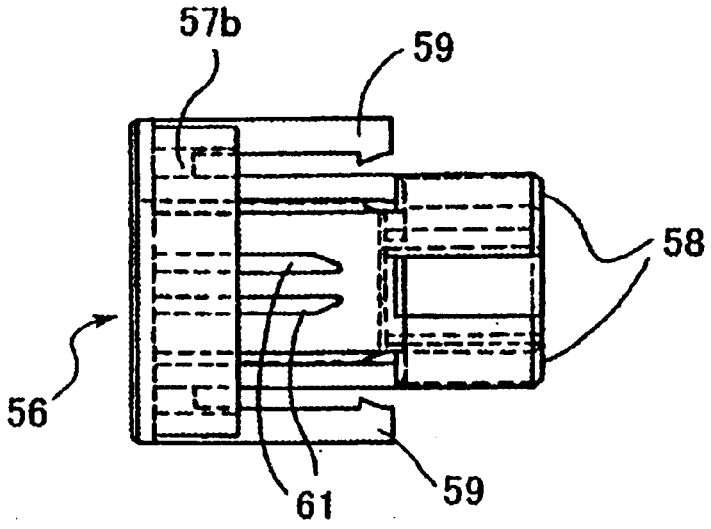
Figure 12D:
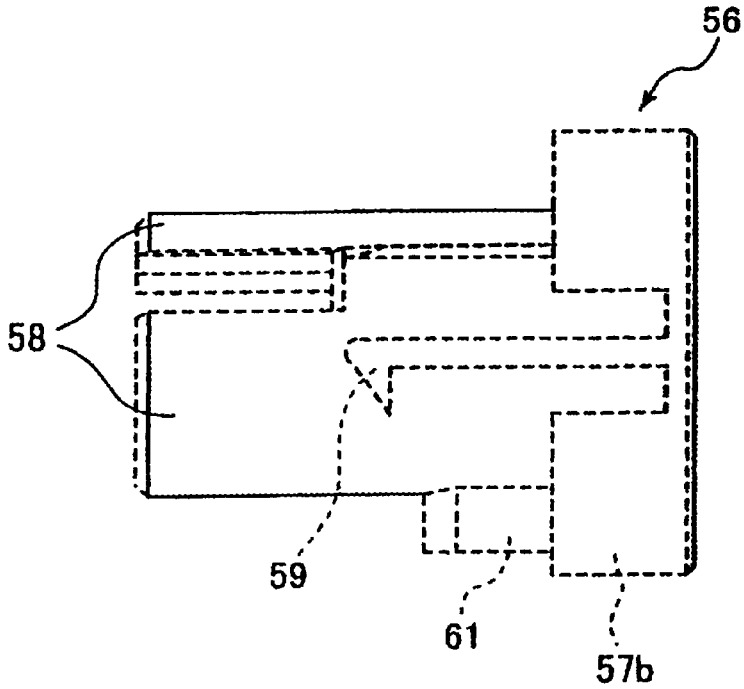
Figure 12E:
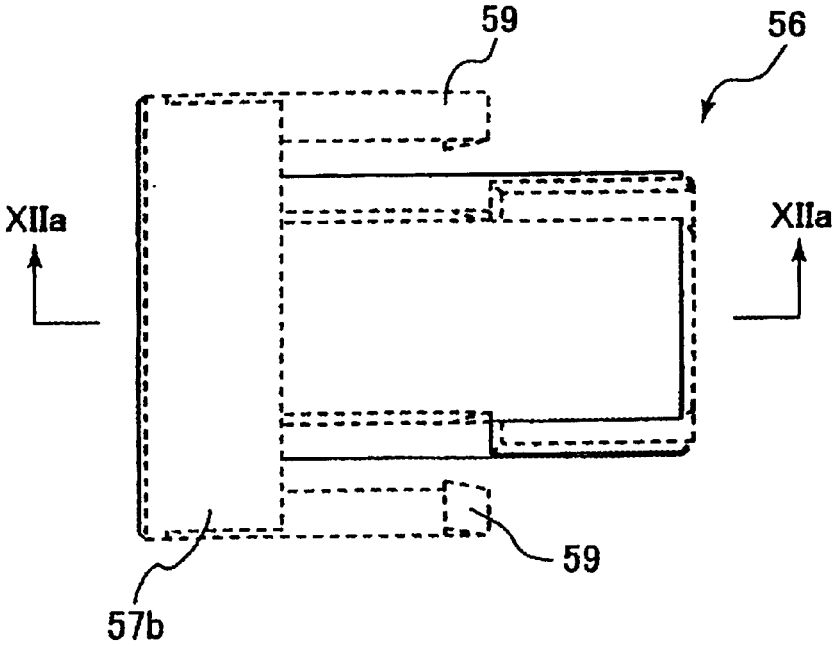
Figure 13A:
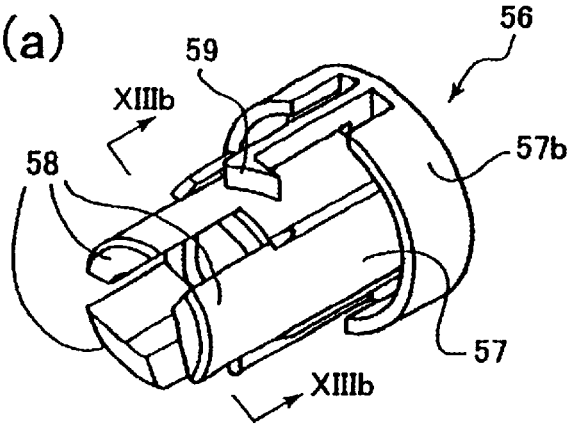
FIG. 13(*a*) is a perspective view showing the intermediate connector.
Figure 13B:
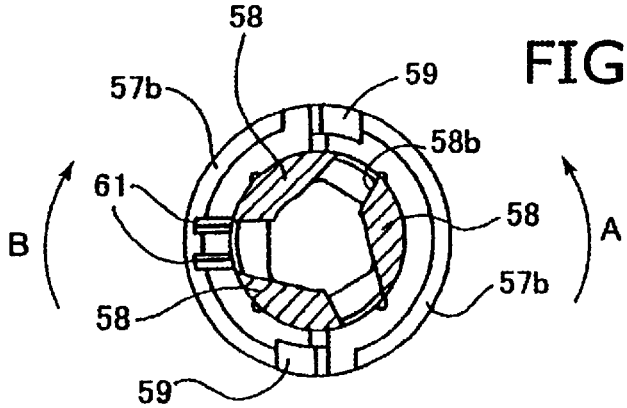
Figure 13C:
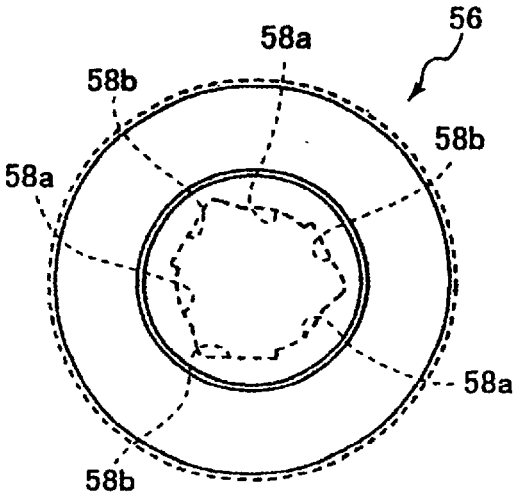
Figure 13D:
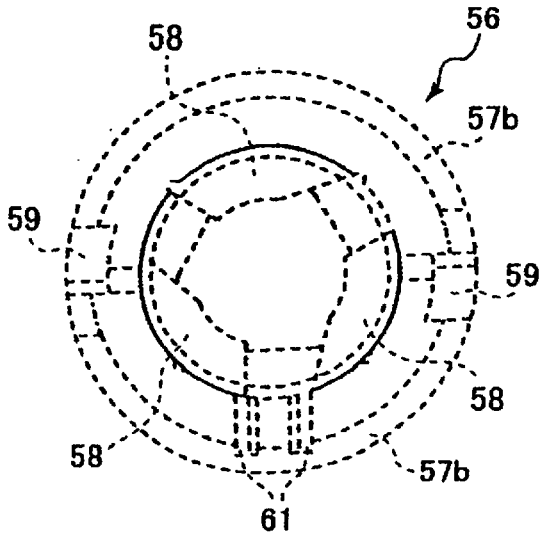

As shown in FIGS. 8 and 9, the takeup-side left spool 38 includes a first rotation member 46 and a shaft member 48, each formed from synthetic resin, such as nylon resin, and produced by injection molding. Once the first rotating member 46 and the shaft member 48 are fitted each other in the shaft hole 50 while the side plate 31*a* interposed therebetween, the first rotating member 46 and the shaft member 48 are unreleasable from each other. That is, the first rotation member 46 engages the shaft member 48 in a manner that the user is unable or hard to disengage the first rotation member 46 from the shaft member 48.

As shown in FIGS. 10(*a*) through 10(*d*), the first rotation member 46 includes a transmission gear 47. The transmission gear 47 has an inner peripheral surface formed with an inner sleeve 46*a* extending from the inner peripheral surface in an axial direction of the transmission gear 47. The inner sleeve 46*a* is formed with a slot 46*c* and a rod-like resilient member 51 provided integrally with the inner sleeve 46*a*. Both the slot 46*c* and the resilient member 51 extend in the axial direction. The resilient member 51 has a free end integrally provided with an engagement pawl 51*a*, which projects radially outwardly. A base portion 46*b* is provided at a radially outer side of the inner sleeve 46*a*. As shown in FIGS. 10(*a*) and 10(*b*), the base portion 46*b* includes three sector pieces equally subdivided in a circumferential direction, thereby defining generally-rectangular-shaped fitting holes 53 between neighboring sector pieces of the base portion 46*b*. Stepped portions 53*a* are provided at radially outer side of the fitting holes 53. As shown in FIG. 10(*a*), positioning projections 54 are provided integrally with the three sector pieces of the base portion 46*b*. Each positioning projection 54 is provided at a position confronting the shaft member 48 and protrudes in the axial direction and extends in a radial direction of the base portion 46*b*.

Next, detailed description for the shaft member 48 will be provided while referring to FIGS. 11(*a*) through 11(*c*). The shaft member 48 has a sleeve base 48*b*. The sleeve base 48*b* has one end provided with a disk-like flange 48*a* protruding radially outwardly, and another end provided with a guide portion 48*c* extending in an axial direction. The guide portion 48*c* is formed with a cutout guide groove 48*d* at its free end, and has a radius smaller than that of the sleeve base 48*b*. The above-described resilient member 51 and the engagement pawl 51*a* of the first rotation member 46 penetrate through the inner peripheral space of the sleeve base 48*b* and the guide portion 48*c*. Three engaging members 52 extend from a radially intermediate portion of the flange 48*a* in a direction opposite to the sleeve base 48*b*. An engagement pawl 52*a* is formed to end portion of each engaging member 52 for locking engagement with each stepped portion 53*a* in a manner described later. Positioning holes 55 and locking holes 71 are formed in alternation at a base end portion of the sleeve base 48*b* and the flange 48*a*. The positioning holes 55 are for engagement with the positioning projections 54 of the first rotation member 46. The locking holes 71 are positioned radially outwardly of the positioning holes 55.

With this arrangement, the first rotation member 46 and the shaft member 48 are fit to the shaft hole 50 of the cartridge body 30 in the following manner. First, the resilient member 51 of the first rotation member 46 is inserted into the shaft hole 50 from outside to inside as shown in FIG. 9. Next, the three engaging members 52 of the shaft member 48 are inserted into the engagement holes 53 of the first rotation member 46 from the inner inside of the left side plate 31*a* while sandwiching the left side plate 31*a* between the first rotation member 46 and the shaft member 48. Accordingly, the engagement pawl 52*a* of each engaging member 52 is brought into locking engagement with each stepped portion 53*a*. Consequently, the first rotation member 46 and the shaft member 48 are connected together and held at the shaft hole 50 unreleaseable from the cartridge body 30.

Figure 14A:
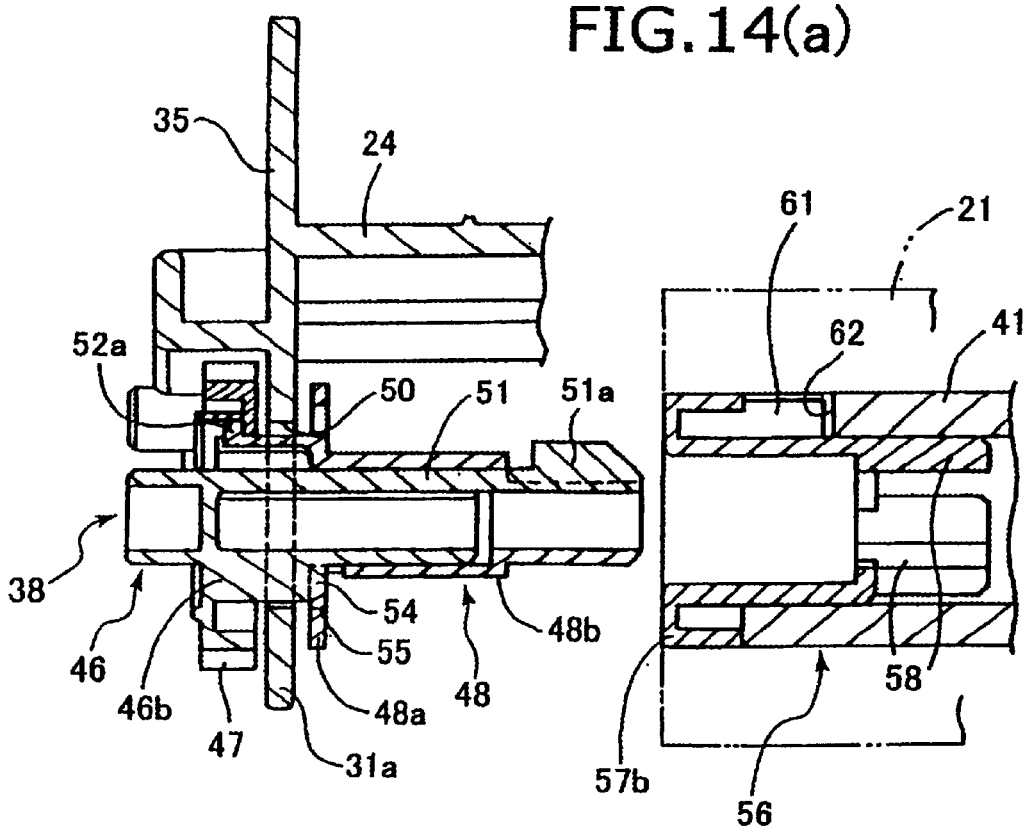
FIG. 14(*a*) is an enlarged cross-sectional view showing the first rotation member and the shaft member engaged with each other and the intermediate connector engaged with the core tube.
Figure 14B:
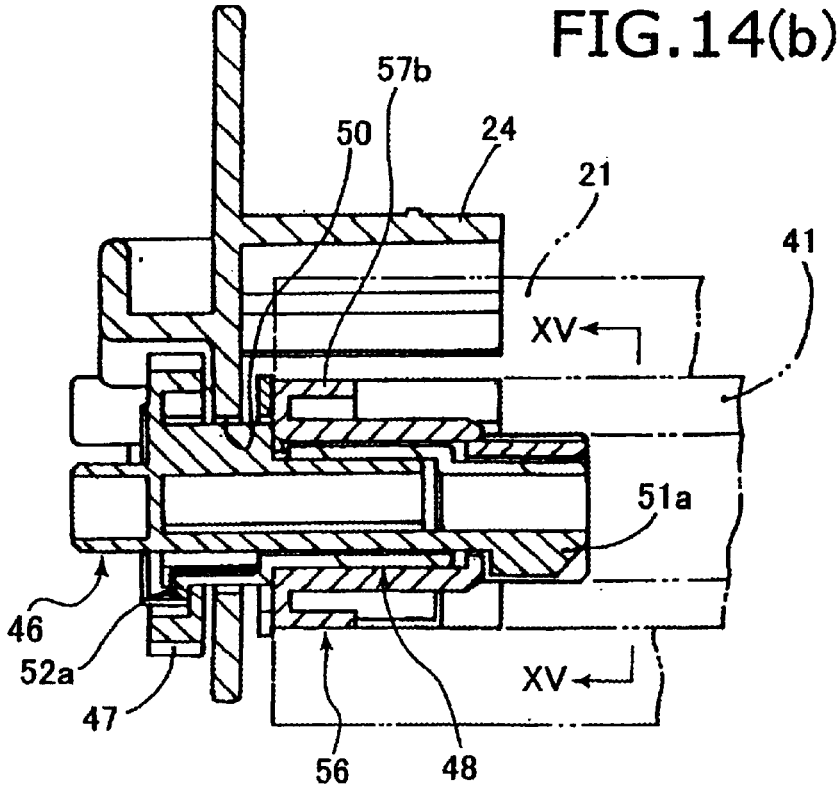

At this time, the positioning projections 54 of the first rotation member 46 also engage respective positioning holes 55 of the shaft member 48. Also, the resilient member 51 engages the cutout guide groove 48*d* of the guide portion 48*c*. As shown in FIG. 11(*c*), the positioning holes 55 have a shape different from each other at every angular position. Also, the shapes of the complementary positioning protrusions 54 also differ from each other at every angular position. With this configuration, the first rotation member 46 and the shaft member 48 are attached each other only with a predetermined correct orientation. It should be noted that when the resilient member 51 is inserted in the cutout guide groove 48*d*, the engagement pawl 51*a* of the resilient member 51 is outwardly urged to protrude in the radial direction from the guide portion 48*c* as shown in FIG. 14(*a*).

Further, when the first rotation member 46 and the shaft member 48 are in engagement with each other, the sleeve base 48*b* of the shaft member 48 and the base portion 46*b* of the first rotation member 46 together define a cylindrical member. As shown in FIGS. 14(*a*) and 14(*b*), the cylindrical member serves as a positioning portion for defining a rotation axis of the transmission gear 47, i.e., that of the takeup-side spool 38, with respect to the shaft hole 50.

FIGS. 34(*a*) to 34(*f*) and 34(*h*) shows the resultant cartridge body 30 with the spool 38 supported within the shaft hole 50 in the above-described manner as viewed from different aspects. Also, FIGS. 34(*g*) and 33(*i*) show the spool 38 supported within the shaft hole 50 and surrounding components.

Next, the intermediate connector 56 will be described while referring to FIGS. 12(*a*) through 12(*e*) and FIGS. 13(*a*) to 13(*d*). The intermediate connector 56 is interposed between the end of the core tube 41 and the shaft member 48 of the spool 38. The intermediate connector 56 includes a sleeve base 57. The sleeve base 57 has at its base-end side an inner peripheral surface 57*a* with a uniform inner diameter D1. As shown in FIG. 11(*a*), the sleeve base 48*b* of the shaft member 48 also has an outer diameter of D1. The sleeve base 48*b* of the shaft member 48 is inserted into and rotatably fitted in the sleeve base 57.

On the other hand, a free end of the sleeve base 57 is subdivided into three segments in its circumferential direction, thereby providing cam segments 58. As shown in FIGS. 13(*a*) to 13(*d*), each cam segment 58 has an uneven inner peripheral surface including a long surface 58*a* and a short surface 58*b*. The inner peripheral surfaces of the cam segments 58 provide an inner diameter where the guide portion 48*c* of the shaft member 48 is rotatably fitted.

As described above, the engagement pawl 51*a* of the resilient member 51 is urged outwardly in the radial direction and protrudes from the guide portion 48*c*. Therefore, when the shaft member 48 rotates in an unwinding direction indicated by an arrow A in FIG. 13 (*b*), the engagement pawl 51*a* slidingly moves on the long surfaces 58*a* of the cam segments 58 against resilient force of the resilient member 51. Therefore, the intermediate connector 56 stays still without rotating even when the resilient member 51, i.e., the spool 38, rotates.

On the other hand, when the resilient member 51 rotates in a winding direction indicated by an arrow B in FIG. 13(*b*), the engagement pawl 51*a* is brought in abutment with one of the short surface 58*b* of the cam segment 58 and in engagement with one of the spaces defined by adjacent two cam segments 58. With this engagement, the intermediate connector 56 rotates integrally with the rotation of the shaft member 48.

That is, the engagement pawl 51*a* can rotate the intermediate connector 56 in the winding direction B, but is prevented from rotating the intermediate connector 56 in the unwinding direction A.

The sleeve base 57 of the intermediate connector 56 has an outermost sleeve portion 57*b* having an outer diameter equal to an outer diameter of the core tube 41. As shown in FIGS. 12(*b*), 12(*c*), and 12(*d*), a pair of rib-like projections 61 extend from the outermost sleeve portion 57*b* in the axial direction thereof, and as shown in FIG. 12 (*b*) one end of the core tube 41 is formed with cutout locking grooves 62 (only one is shown in FIG. 12(*b*)), with which the projections 61 are engaged. Consequently, rotation of the intermediate connector 56 integrally rotates the core tube 41. With this configuration, transmission torque transmitted from main body side of the facsimile device 1 can be transmitted to the takeup-side member 26 without fail.

Further, as shown in FIGS. 12(*b*) to 12(*e*) and FIGS. 33(*a*) to 33(*i*), a pair of resilient pawls 59, 59 are formed extending in the axial direction from the outermost sleeve portion 57*b* of the intermediate connector 56, and a pair of mating grooves 60 are formed at the left end of the core tube 41. The mating grooves 60 are used for preventing rotation and have an L-shape in a plan view. When the sleeve base 57 of the intermediate connector 56 is inserted into the left end of the core tube 41, each resilient pawl 59 engages the corresponding mating groove 60. This arrangement prevents an ink-sheet set (described later) having no mating groove at its takeup-side core tube from being installed into the ink sheet cartridge 20 of the present invention because it is unable to insert the spool 38 to the core tube. This prevents mistaking installation of an ink sheet having a quality different from that of the regular ink sheet 21, such as those of different manufacturer, and accordingly prevents troubles in printing, such as degradation of printing quality, caused by mistaking installation of an ink sheet. It should be noted that only one resilient pawl 59 and one mating groove 60 can be formed instead.

Next, installation of an exchangeable ink-sheet set onto the cartridge body 30 will be described. The exchangeable ink-sheet set is a set of the supply-side core tube 40, a new ink sheet 21 wound thereover, and the takeup-side core tube 41. A leading end of the new ink sheet 21 is attached to the outer peripheral surface of the core tube 41 by an adhesive tape. It is preferable that the ink sheet 21 has a width equal to a distance from an end of the outermost sleeve portion 57*b* of the intermediate connector 56 fitted with the core tube 41 to right end of the core tube 41.

The intermediate connector 56 can be fitted with the left end of the core tube 41 beforehand if desired. In this case, any assembly error with respect to the takeup-side spool 38 can be avoided in case of exchange of the ink-sheet set, thereby facilitating the exchanging work.

The first rotation member 46 and the shaft member 48 has already been unreleasably installed to the shaft hole 50 of the cartridge body 30 in a manner described above and shown in FIG. 14(*a*). Also, the intermediate connector 56 is provisionally unreleasably fitted with the left end of the takeup-side core tube 41.

First, the takeup-side right spool 39 is inserted into the right end of the core tube 41, and the supply-side spools 36 and 37 are inserted into the respective ends of the supply-side core tube 40 as shown in FIG. 8. Next, the sleeve base 48*b* of the shaft member 48 is inserted into the inner peripheral surface 57*a* of the intermediate connector 56. Then, the intermediate connector 56 is rotated relatively to the shaft member 48 so that the engagement pawl 51*a* fits in one of the spaces defined by adjacent two cam segments 58 in a manner described above. Because only by inserting the sleeve base 48*b* into the inner peripheral surface 57*a*, the engagement pawl 51*a* can be engaged with the can segment 58, attachment and detachment work can be facilitated.

Because one spool, i.e., the takeup-side left spool 38, is unreleasably held on the cartridge body 30 as described above, a user can easily recognize the position of the transmission gear 47 with respect to the cartridge body 30. Consequently, the user can easily attach the spools 36, 37, 39 to respective ends of the core tubes 40, 41 with proper orientations. Thus, replacement of ink-sheet sets can be performed promptly and easily.

Next, the spools 36, 37, 39 are fitted with the corresponding shaft support grooves 33, 33, 33 of the cartridge body 30. Then, the core tube 41 is manually rotated in the winding direction B to remove a slack of the ink sheet 21.

When the ink sheet cartridge 20 is accommodated to the accommodating portion 13 of the facsimile device 1, the left and right side plates 31*a*, 31*b* of the cartridge body 30 are held at their predetermined postures. At this time, inner peripheral surfaces of the shafts 44, 44 of the spools 37, 39 engage respective shafts (not shown) protruding from one side of the main body case 2 of the facsimile device 1. At the same time, the gear wheel 45 of the spool 36 and the transmission gear 47 of the spool 38 are respectively in meshing engagement with power transmission gears (not shown) provided to the main body case 2. Further, inner surfaces of an outer sleeve portion 36*a* of the spool 36 shown in FIG. 8 and the outer sleeve portion 51*b* of the spool 38 are engaged with corresponding shafts (not shown) resiliently protruding from another side of the main body case 2 of the facsimile device 1. This arrangement enables the supply side member 25 and the takeup side member 26 to smoothly rotate.

Figure 15:
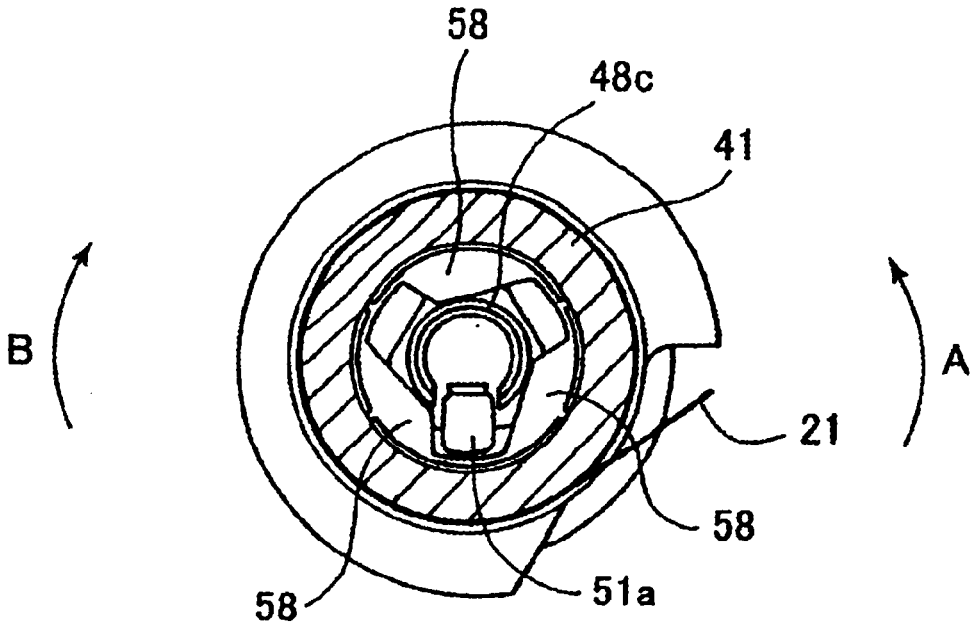
FIG. 15 is a cross-sectional view taken along the line XV—XV of FIG. 14(*b*)

Printing is started upon operation of the control baseboard 29 based on either a printing command inputted from the operation panel 3, a printing command received from an external computer (not shown), or facsimile data transmitted from other facsimile device via a public line. Once the printing is started, first the sheet supply roller 15 rotates to start supply of the recording sheet 4. After a sheet sensor (not shown) has detected the leading end of the recording sheet 4, the recording sheet 4 is further transported by a predetermined distance. When the leading end approaches the platen 17, a driving force is transmitted to the platen 17 and also to the gear wheel 45 and the transmission gear 47 of the ink sheet cartridge 20. Because the engagement pawl 51*a* of the resilient member 51 has already brought into engagement with the space between the neighboring cam segments 58 of the intermediate connector 56 as shown in FIG. 15, the rotation of the transmission gear 47 is reliably transmitted to the core tube 41. As a result, transportation of the ink sheet 21 is performed concurrent with the transportation of the recording sheet 4, and printing is performed onto the recording sheet 4 by the thermal head 22.

Specifically, the heat generating resistor of the thermal head 22 generates heat in accordance with the print data, while both the ink sheet 21 and the recording sheet 4 are nipped at the printing portion 17*a* between the platen 17 and the thermal head 22. The heat from the thermal head 22 selectively melts the ink on the ink sheet 21, and the melted ink is transferred onto a bottom surface of the recording sheet 4, thereby forming an ink image thereon at every one line basis. It should be noted that the ink on the recording sheet 4 is cooled off meanwhile and keeps clinging on the recording sheet 4.

After the printing, the ink sheet 21 alone is largely bent downwardly at the top 23*a* of the tension member 23 and separated from the recording sheet 4. Then, the ink sheet 21 is fed toward the lower outer peripheral portion of the takeup-side member 26 as shown in FIG. 2. On the other hand, the recording sheet 4 is transported along the upper surface of the partitioning plate 24. At this time, the knob portions 35, 35 positioned at left and right ends of the partitioning plate 24 serves as guides for guiding the left and right edges of the recording sheet 4.

Incidentally, one end of the partitioning plate 24 close to the tension member 23 functions to bend the leading portion of the recording sheet 4 downwardly. This surely allows the leading end of the recording sheet 4 to ride over the upper surface of the partitioning plate 24, thereby reliably preventing the recording sheet 4 from being transported downwardly along with the ink sheet 21. In this way, the ink sheet 21 is easily and surely separated from the recording sheet 4 by the tension member 23 and the partitioning plate 24.

Also, because the center space of the ink sheet cartridge 20 is defined between the supply-side member 25 and the partitioning plate 24, the recording sheet 4 is promptly separated from the ink sheet 21 immediately after the printing by simply traveling the recording sheet 4 along the upper surface of the partitioning plate 24. This results in a simple and compact structure of the ink sheet cartridge 20 and the facsimile device 1, and reduces production costs.

The plurality of rib-like projections 24*a* of the partitioning plate 24 extend in the sheet transporting direction. Therefore, the printed surface, i.e., the bottom surface, of the recording sheet 4 is subject to less friction from the partitioning plate 24 when the recording sheet 4 passes along the partitioning plate 24. This configuration reduces contamination of the recording sheet 4 with an ink, which has accidentally been deposited on the partitioning plate 24.

As described above, according to the first embodiment, because the partitioning plate 24 serves as the lower transporting chute, the recording sheet 4 can be reliably introduced into the space between the upper chute portion 27 and the partitioning plate 24. When the upper cover 6 are pivotally lifted up about the pivot point 6*a*, the upper chute portion 27 is also lifted up. Further, because the ink sheet cartridge 20 is set in the hip-up orientation, and because the recording sheet 4 is transported from the upper rear portion to the lower front end of the main body case 2 along the upper side of the ink sheet cartridge 20, when sheet jamming occurs, a large open space can be provided between the upper chute portion 27 and the partitioning plate 24 by simply lifting up the upper cover 6. Accordingly, a jammed recording sheet 4 can be easily removed, and the transporting chute defined by the partitioning plate 24 and the upper chute portion 27 will not obstruct exchange of the ink sheet cartridge 20.

If a pair of upper and lower parts of transporting chute are formed as components separated from the ink sheet cartridge, there is a need to remove the transporting chute from the main body case of the facsimile device every time the user replaces the ink sheet. However, according to the configuration of the present invention, there is no need for the user to remove the transporting chute when replacing the ink sheet.

Next, an ink sheet cartridge 120 according to a second embodiment of the present invention will be described while referring to FIGS. 16 to 18(*c*). The ink sheet cartridge 120 has the similar configuration as the ink sheet cartridge 20 of the first embodiment. However, the ink sheet cartridge 120 has a takeup-side core tube 141 different from the core tube 41, and does not include the intermediate connector 56. Other components are the same as that of the first embodiment, so these components are assigned with the same numberings, and detailed explanations for these components will be omitted.

Figure 16:
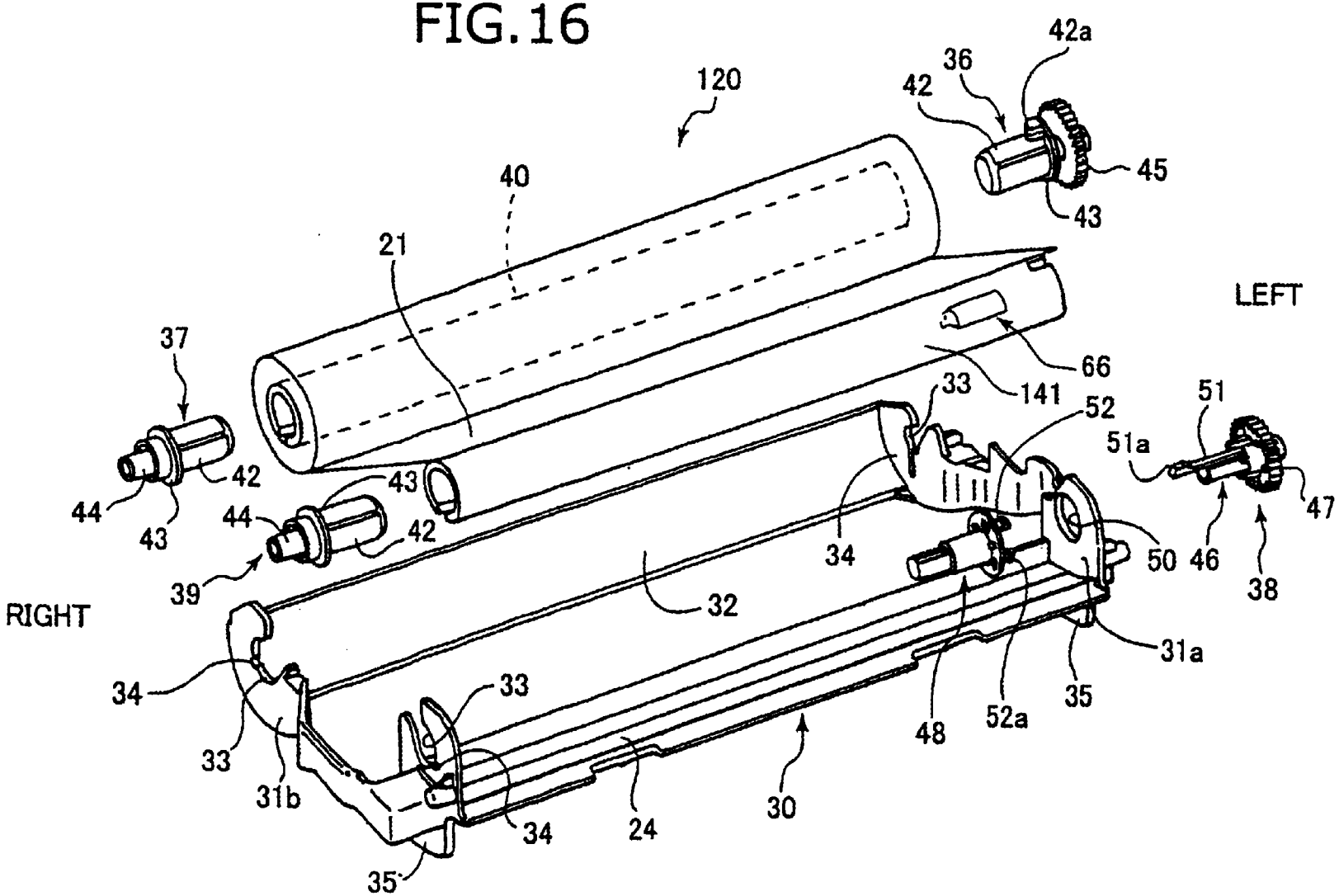
FIG. 16 is an exploded perspective view showing components of an ink sheet cartridge according to a second embodiment of the present invention where the ink sheet cartridge is turned upside down.
Figure 17:
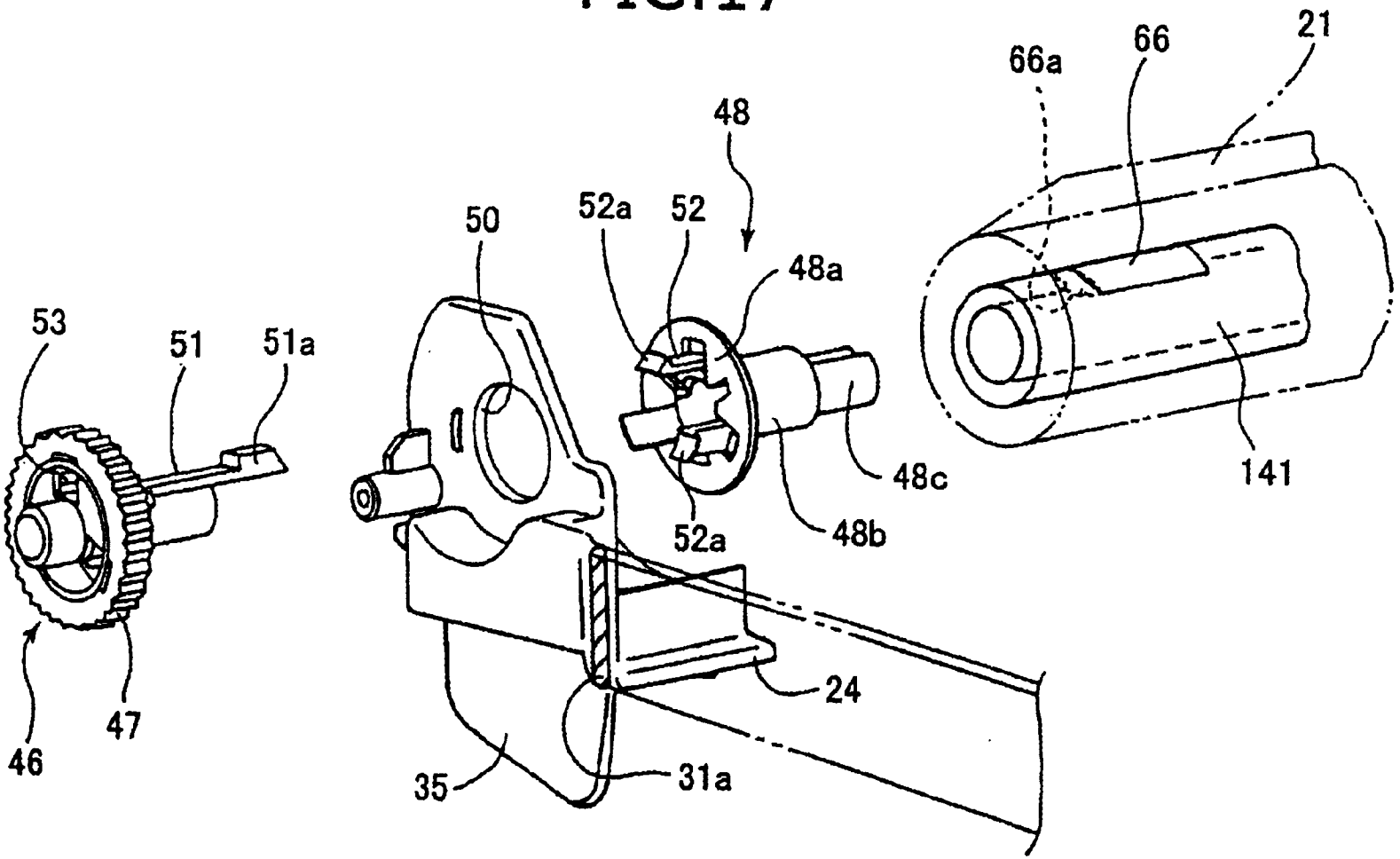
FIG. 17 is an exploded perspective view of a takeup-side left spool of the ink sheet cartridge of FIG. 16.
Figure 18A:
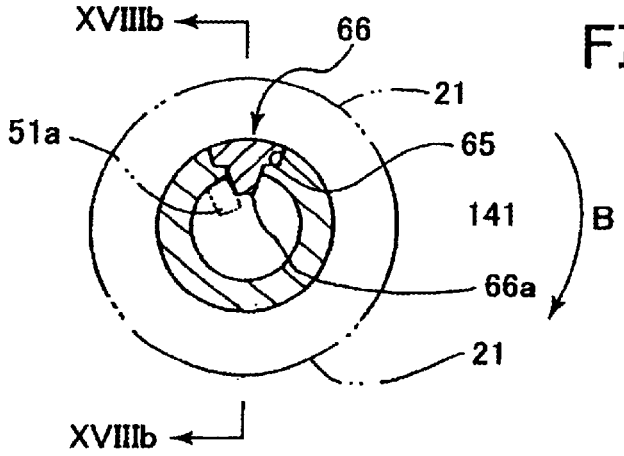
FIG. 18(*a*) is a cross-sectional view of a takeup-side core tube of the ink sheet cartridge of FIG. 16.
Figure 18B:
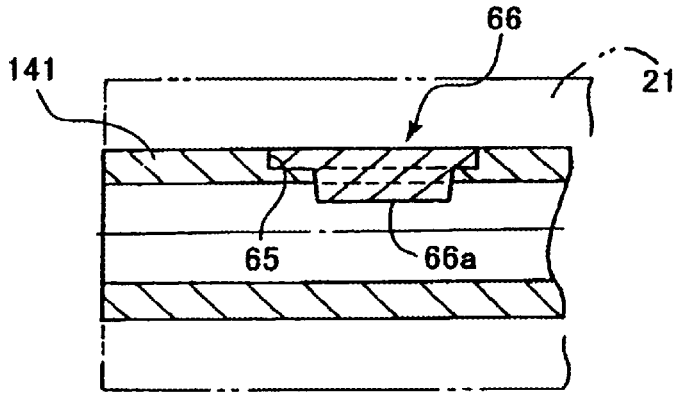
Figure 18C:
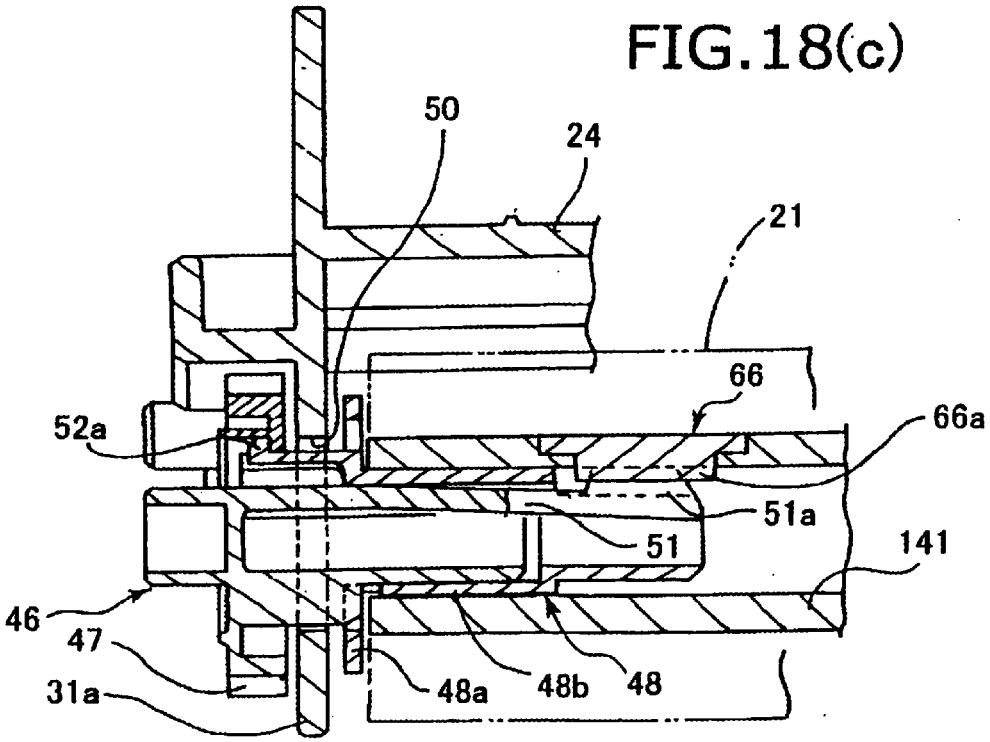

As shown in FIGS. 16, 17, 18(*a*), and 18(*b*), the core tube 141 is formed with an attachment hole 65 at its left end portion. The attachment hole 65 has a generally rectangular shape in a plan view, and has a radially outer section and a radially inner section, each open at the outer and inner peripheral surfaces of the core tube 141, respectively. The radially outer section has an area greater than that of the radially inner section. As shown in FIGS. 18(*a*) and 18(*b*), a separate engagement projecting member 66 formed of a synthetic resin is inserted into the attachment hole 65 from the outside of the core tube 141, and fixed thereto by an adhesive agent. The engagement projecting member 66 has a radially outer portion and radially inner portion integrally formed with the radially outer portion. The radially outer portion complementarily engages the radially outer section of the attachment hole 65, so that the engagement projecting member 66 cannot drop radially inwardly into the core tube 141. Moreover, the radially outer portion has an outer arcuate surface whose radius of curvature is equal to that of the outer peripheral surface of the core tube 141. The radially inner portion of the engagement projecting member 66 protrudes toward a center axis of the core tube 141 to provide an engagement portion 66*a*. As will be described later, the engagement portion 66*a* is abuttable on the side surface of the engagement pawl 51*a* provided at the tip end of the resilient member 51.

Incidentally, the attachment hole 65 shown in FIGS. 18(*a*) and 18(*b*) is formed with a stepped portion at the boundary between the radially outer section and the radially inner section. However, an attachment hole having a sector shape in cross-section in which a radially outer section has a circumferential length grater than that of a radially inner section can be used instead. In this case, an engagement projection has a complementary sector shape in cross-section. This arrangement also prevents the engagement projection from being dropped into the internal of the core tube 141.

Next, installation of an exchangeable ink-sheet set onto the cartridge body 30 will be described. The exchangeable ink-sheet set is a set of the supply-side core tube 40, a new ink sheet 21 wound thereover, and the takeup-side core tube 141. The engagement projecting member 66 is provisionally fixed to the attachment hole 65 of the core tube 141. The ink sheet 21 has a width preferably equal to a distance between the right and left ends of the core tube 141. A leading end of the ink sheet 21 is provisionally attached to the outer peripheral surface of the core tube 141 by an adhesive tape. Further, the shaft member 48 and the first rotation member 46 are unreleasably assembled into the shaft hole 50 of the cartridge body 30 in the same manner as in the above-describe first embodiment. That is, the resilient member 51 is inserted in the cutout guide groove 48*d*, and the engagement pawl 51*a* is outwardly urged to protrude in the radial direction from the guide portion 48*c*.

First, the supply-side left and right spools 36 and 37 are respectively inserted into the left and right ends of the supply-side core tube 40 in the same manner as in the first embodiment.

Then, the guide portion 48*c* of the shaft member 48 is directly inserted into the left end of the core tube 141. At this time, because the free end of the resilient member 51 is urged radially outwardly, the resilient member 51 will be deformingly bent as shown in FIG. 18(*c*) such that the engagement pawl 51*a* is in sliding relation with the inner peripheral surface of the core tube 141. When the guide portion 48*c* is inserted into the core tube 141 by a relatively large predetermined depth, then the spool 38 is rotated in the winding up direction B so that the engagement pawl 51*a* is brought into abutment with the side surface of the engagement portion 66*a* as shown in FIG. 18(*a*). This configuration provides a torque transmission mechanism. Then, the spools 39, 36, 37 are fitted at the corresponding shaft support grooves 33 of the cartridge body 30.

Because only one spool, i.e., the takeup-side left spool 38, is unreleasably held on the cartridge body 30 as described above, a user can easily recognize the position of the transmission gear 47 with respect to the cartridge body 30. Consequently, the user can easily attach the spools 36, 37, 39 to respective ends of the core tubes 40, 141 with proper orientations when the user replaces the ink-sheet set. Thus, replacement of ink-sheet sets can be performed promptly and easily.

Also, the above configuration prevents the ink sheet cartridge 120 of the present embodiment from accommodating an ink-sheet set having a takeup-side core tube provided with no engagement portion 66*a*, and therefore reliably prevents misuse of an ink sheet having a quality different from that of the ink sheet 21 of the present invention in the facsimile device 1. Consequently, degradation of printing quality and any printing deficiency caused by the misuse can be obviated.

When the resultant ink sheet cartridge 120 assembled with the ink-sheet set is mounted on the accommodating portion 13, the inner peripheral surface of the core tube 141 is supported concentrically by the sleeve base 48*b* of the spool 38. Because the first rotation member 46 and the shaft member 48 of the spool 38 are integrally fitted with each other, and because the engagement pawl 51*a* is in abutment with the engagement portion 66*a*, the rotation force from the transmission gear 47 in the winding direction B can be transmitted to the core tube 141. In this way, feeding of the ink sheet 21 is performed.

Figure 19A:
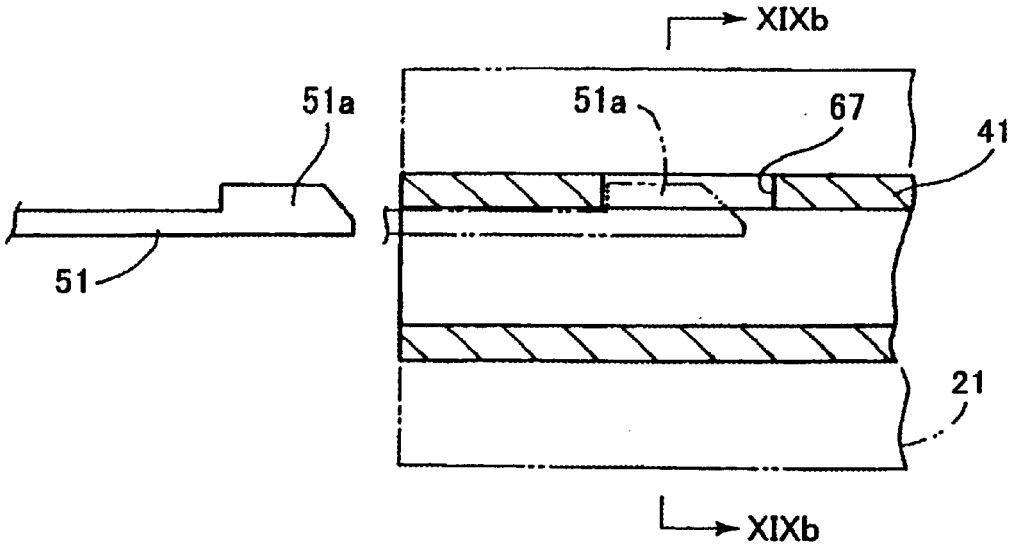
FIG. 19(*a*) is an enlarged cross-sectional partial view of an ink sheet cartridge according to a first modification of the second embodiment of the present invention.
Figure 19B:
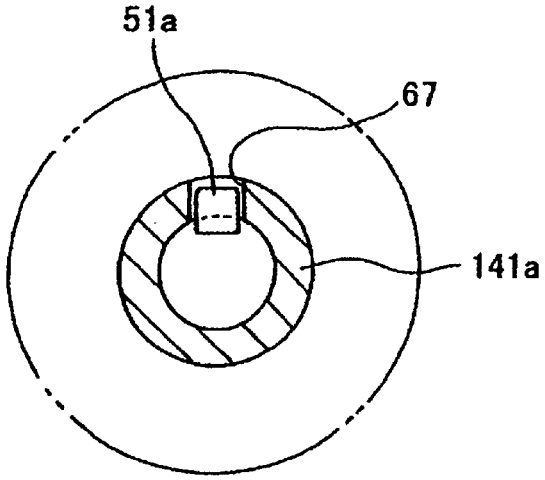

Next, a first modification of the second embodiment will be described while referring to FIGS. 19(*a*) and 19(*b*) According to the present modification, as shown in FIGS. 19(*a*) and 19(*b*), a takeup-side core tube 141*a* is formed with an engagement hole 67 instead of the attachment hole 65. The engagement hole 67 has a rectangular shape extending in the axial direction. When the spool 38 is inserted into the core tube 141*a*, the resilient member 51 is deformed while the engagement pawl 51*a* is in sliding contact with the inner peripheral surface of the core tube 141*a*. Then, the engagement pawl 51*a* is brought into engagement with the engagement hole 67. In this modification also, an inner diameter of the core tube 141*a* is set equal to an outer diameter of the sleeve base 48*b* of the shaft member 48.

Accordingly, a driving force from the main body of the facsimile device 1 is transmitted to the core tube 141*a* via the transmission gear 47 and the resilient member 51. Function and effect is the same as those of the second embodiment.

Figure 20:
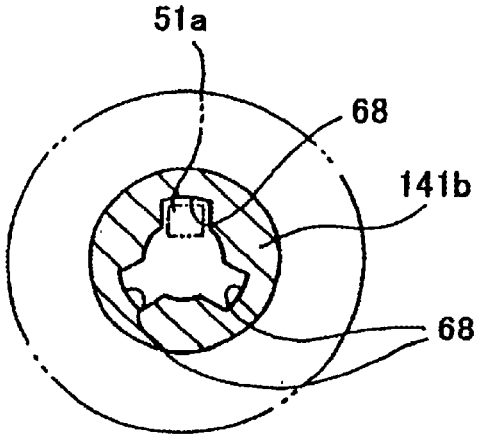
FIG. 20 is a cross-sectional view of a takeup-side core tube of an ink sheet cartridge according to a second modification of the second embodiment of the present invention.

FIG. 20 shows a second modification of the second embodiment. As shown in FIG. 20, a takeup-side core tube 141*b* has a spline-like inner shape in cross-sectional view. That is, the core tube 141*b* has an inner peripheral surface formed with a plurality of engagement grooves 6*a* defined by a plurality of ribs extending in the axial direction of the core tube 141*b*. With this configuration, the engagement pawl 51*a* of the spool 38 engages one of the plurality of engagement grooves 68. Function and effect are approximately the same as those of the second embodiment. The engagement grooves 68 can be formed to either the entire length of the core tube 141*b* in the axial direction or only a predetermined depth from the left side of the core tube 141*b* as long as the engagement pawl 51*a* can engage.

It should be noted that in case of the second modification, the resilient member 51 can be dispensed with, and a cross-sectional shape of the sleeve base 48*b* of the spool 38 can be made in conformance with the engagement groove 68 of the core tube 141*b*. Also, only a single engagement groove can be formed.

According to a further alternative, an engagement projection 66 can be provided at one end of the core tube 40, and the small diameter inner sleeve 42 of the supply side spool 36 can be provided with an engagement pawl (not shown) engageable with the engagement projection 66. In the latter case, the resilient member 51 at the first rotation member 46 can be dispensed with, and instead, the above described engagement portion 66*a* can be engaged with the cutout guide groove 48*d* at the guide portion 48*c* of the shaft member 48.

Next, an ink sheet cartridge 220 according to a third embodiment of the present invention will be described while referring to FIGS. 21 to 25. The ink sheet cartridge 220 is similar to the ink sheet cartridge 20 of the first embodiment except that the ink sheet cartridge 220 includes a takeup-side core tube 241 and the intermediate connector 70 different from the takeup-side core tube 41 and the intermediate connector 56. Details will be described below.

Figure 21:
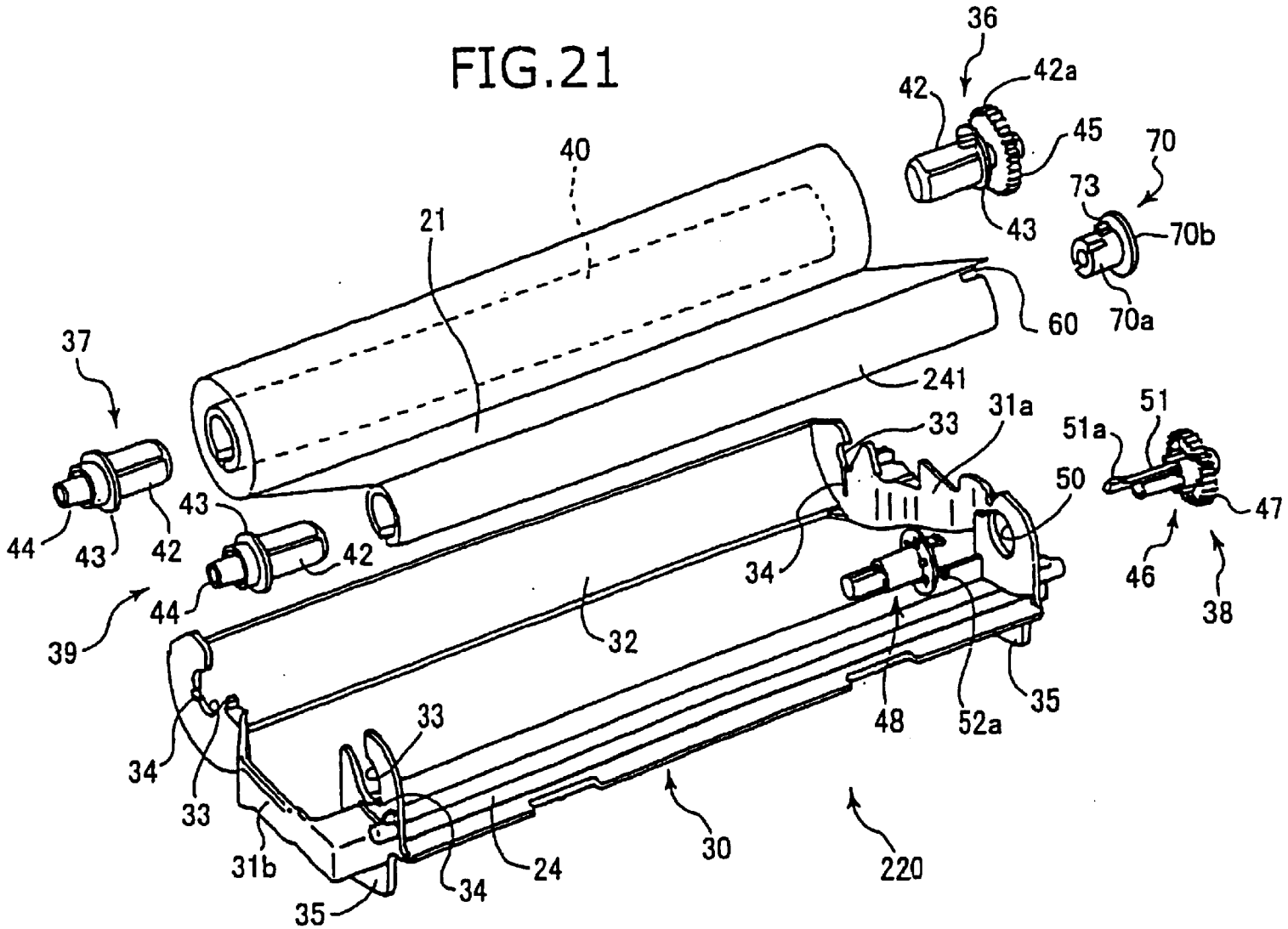
FIG. 21 is an exploded perspective view showing components of an ink sheet cartridge according to a third embodiment of the present invention where the ink sheet cartridge is turned upside down.
Figure 22:
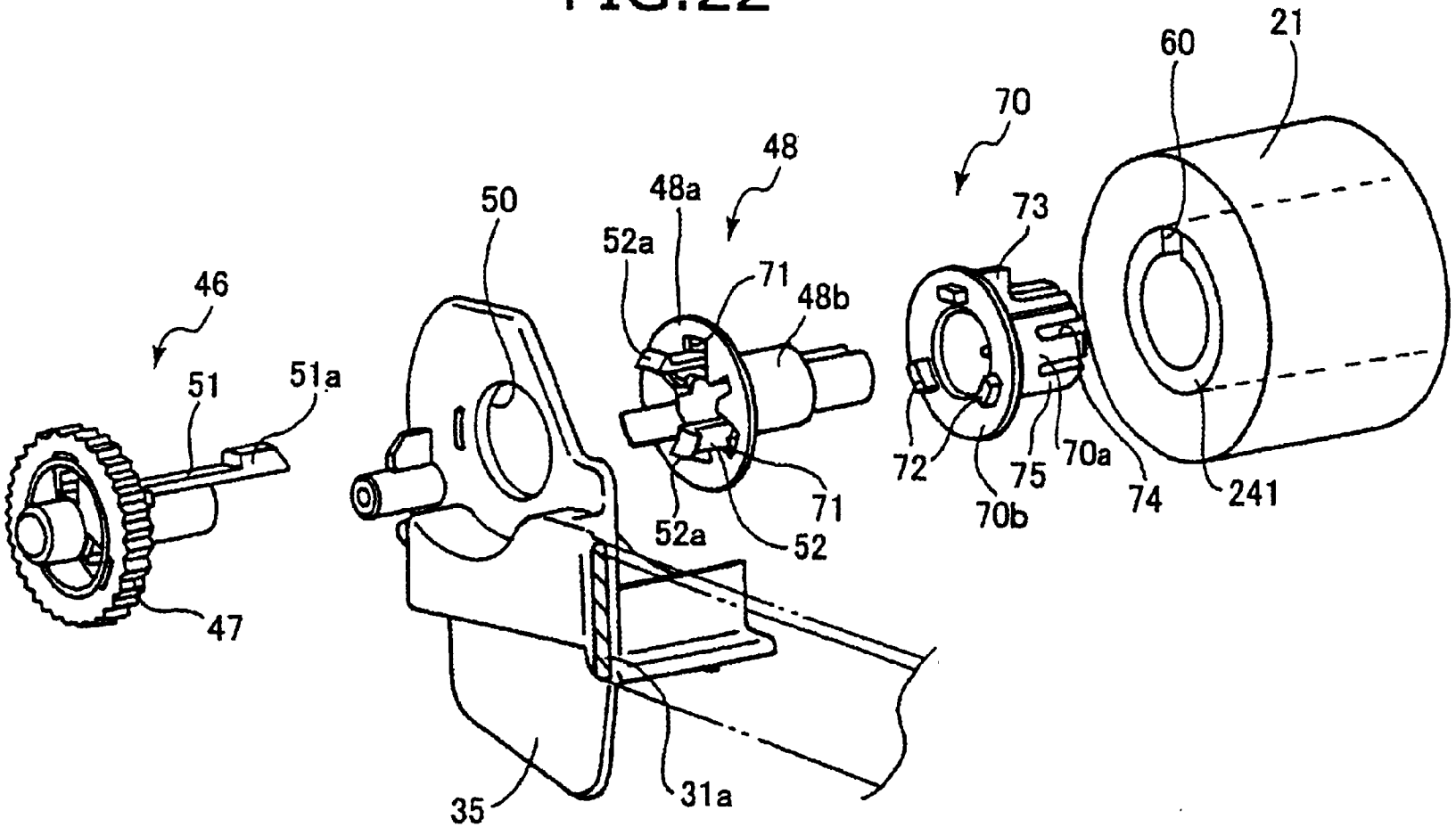
FIG. 22 is an exploded perspective view of a takeup-side left spool and other components of the ink sheet cartridge of FIG. 21.

As shown in FIGS. 21 and 22, the takeup-side core tube 241 is formed with a mating groove 60 at its left end. The core tube 241 has a different inner diameter depend on the kind of the ink sheet 21 that is wound therearound, such as a sheet material, a width, and a thickness of the ink sheet 21.

The intermediate connector 70 is a sleeve like member produced from a synthetic resin by an injection molding, and has a size in conformance with the inner diameter of the core tube 241. The intermediate connector 70 includes a sleeve portion 70*a*, a flange portion 70*b*, first locking projections 72, and a second locking projection 73, all integrally formed one another.

The sleeve portion 70*a* is tightly fitted into the inner peripheral surface of the core tube 241. As shown in FIG. 22, the outer peripheral surface of the sleeve portion 70*a* is formed with a plurality of cutout grooves 74 and a plurality of ribs 75 extending in the axial direction thereof. The cutout grooves 74 facilitate flex of the sleeve portion 70*a* when inserted into the core tube 241. On the other hand, the ribs 75 facilitate insertion of the sleeve portion 70*a* into the core tube 241.

Figure 23A:
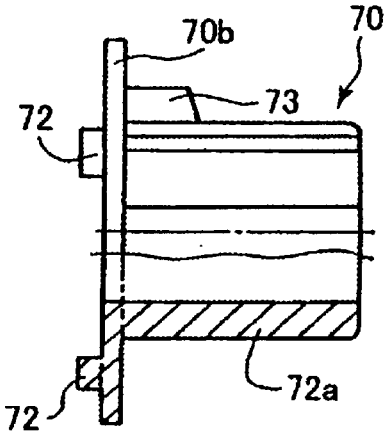
FIG. 23(*a*) is a partial cross-sectional view of an intermediate connector of the ink sheet cartridge of FIG. 21.
Figure 23B:
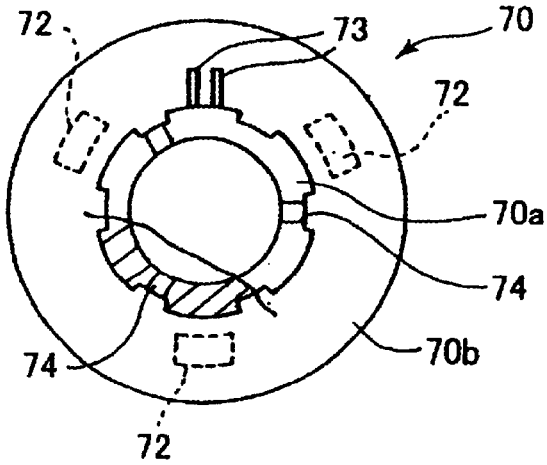
Figure 25:
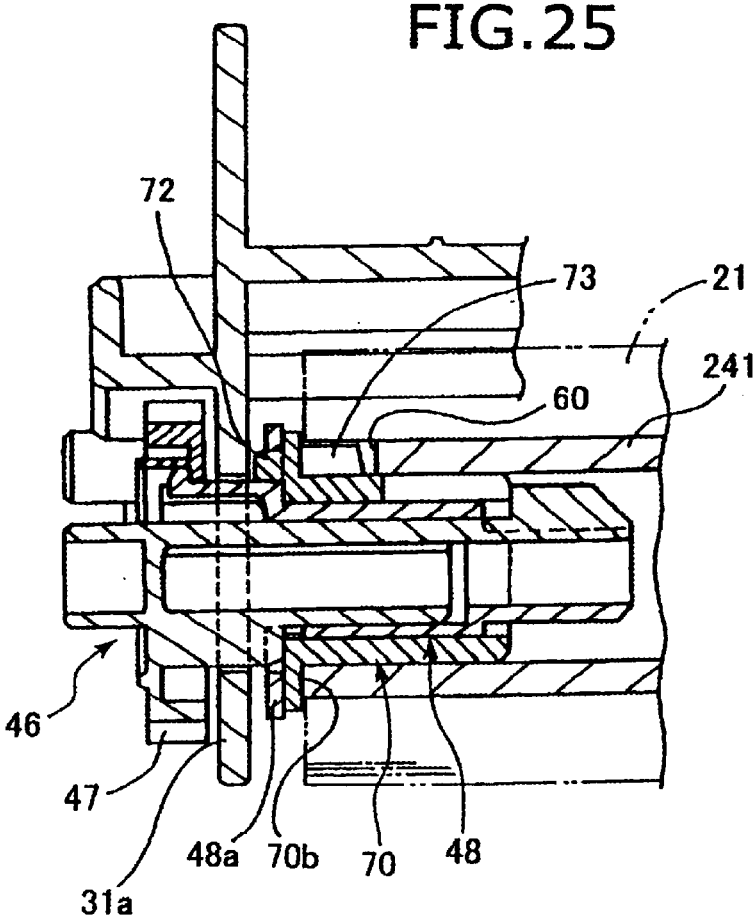
FIG. 25 is an enlarged cross-sectional view showing the complete assemble of the first rotation member, the shaft member, the intermediate connector, and the takeup-side core tube.
Figure 24:
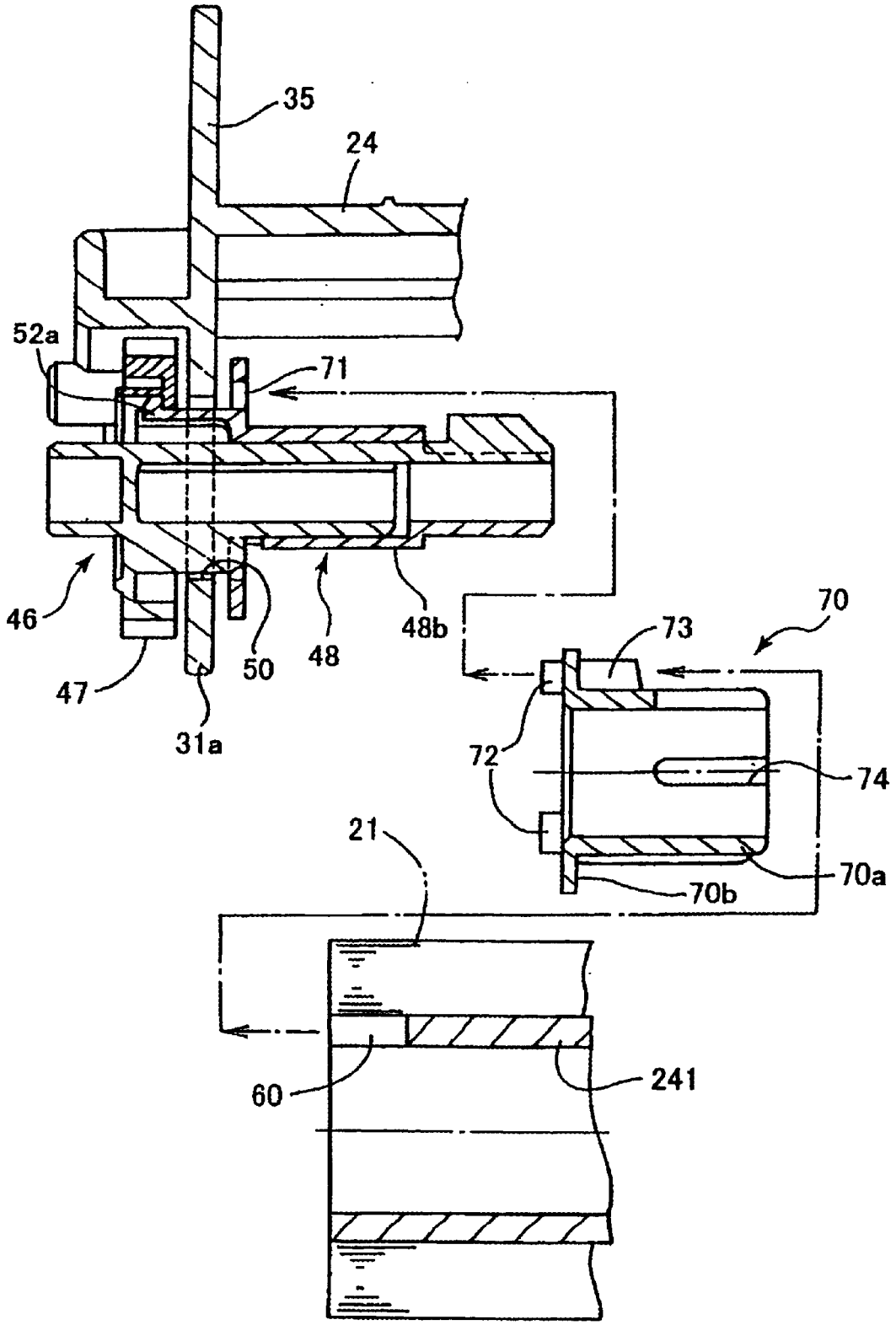
FIG. 24 is a cross-sectional view showing the left end portion of the core tube and other components of the ink sheet cartridge of FIG. 21.

The flange portion 70*b* is slidable on the periferal surface of the sleeve base 48*b* of the shaft member 48. The first locking projections 72 protrude from one side surface of the flange portion 70*b* for engagement with the locking holes 71 of the flange 48*a*. The second locking projection 73 protrudes radially outwardly from the outer peripheral surface of the sleeve portion 70*a*. As shown in FIGS. 23(*a*) and 23(*b*), the second locking projection 73 has a bifurcated form and, as shown in FIG. 25, is engageable with the mating groove 60 of the core tube 241.

Next, installation of an exchangeable ink-sheet set onto the cartridge body 30 of the ink sheet cartridge 220 will be described. The exchangeable ink-sheet set is a set of the supply-side core tube 40, a new ink sheet 21 wound therearound, the takeup-side core tube 241, and the intermediate connector 70. The intermediate connector 70 can be fitted with the left end of the core tube 241 beforehand. Alternatively, the intermediate connector 70 can be prepared as an optional piece.

The ink sheet 21 has a width preferably equal to a distance between the right and left ends of the core tube 241. A leading end of the ink sheet 21 is provisionally attached to the outer peripheral surface of the core tube 241 by an adhesive tape. Also, the first rotation member 46 and the shaft member 48 are unreleaseably assembled together to the shaft hole 50 so as to provide the takeup-side left spool 38 as shown in FIG. 25.

First, the intermediate connector 70 is interposed between the left end of the take-up side core tube 241 and shaft portion 48 of the take-up side left spool 38. Then, the shaft portion 48 is inserted into the core tube 241 such that the sleeve portion 70*a* of the intermediate connector 70 is tightly fitted between the outer peripheral surface of the sleeve base 48*b* and the inner peripheral surface of the core tube 241. At this time, the first locking projections 72 are engaged with the first locking holes 71, and the second locking projection 73 is engaged with the mating groove 60.

It should be noted that the intermediate connector 70 can be provisionally mounted over the sleeve base 48*b* such that the first locking projections 72 are engaged with the locking holes 71 of the flange 48*a*.

Then, the takeup-side right spool 39 is inserted into the right end of the core tube 241, and the supply side left and right spools 36 and 37 are respectively inserted into the left and right ends of the supply-side core tube 40.

Because the first rotation member 46 and the shaft member 48 are integrally fitted with each other, and because the intermediate connector 70 having the first and second locking projections 72, 73 is interposed between the spool 38 and the core tube 241, the rotation force of the transmission gear 47 in the winding direction can be transmitted to the core tube 241.

According to the above-described third embodiment, the intermediate connector 70 can be inserted into only the left end of the core tube 241. Therefore, an ink-sheet set having a takeup-side core tube whose inner diameter is not matched with the intermediate connector 70 of the present embodiment, such as an ink-sheet set of other manufacturers, cannot be assembled into the ink sheet cartridge 220. This prevents misuse of an ink sheet having a quality different from the regular ink sheet 21. Consequently, degradation of printing quality and any printing deficiency caused by the misuse can be obviated.

Because various intermediate connectors 70 can be prepared in conformance with the inner diameter of the core tube 241, an optimum one of the intermediate connectors 70 can be replaceably used in accordance with the kind of the ink sheet 21 to be used. Accordingly, a user can simply use an exchangeable ink-sheet set, which includes the ink sheet 21, the core tubes 40, 241, and the corresponding intermediate connector 70 without preparing different left spools 38 for different ink sheets.

Further, because the first locking projections 72 are engaged with the corresponding locking holes 71, the locking position can be sufficiently far from the rotation center of the spool 38. As a result, force of transmission torque from the shaft member 48 to the intermediate connector 70 can be less. Consequently, thickness of the flange portion 70*b* can be reduced, and so the intermediate connector 70 can be made in a compact size.

It should be noted that in the present third embodiment the resilient member 51 and the engagement pawl 51*a* can be dispensed with. Alternatively, the engagement pawl 51*a* can engage an engagement hole (not shown) formed to the core tube 241 having a relatively small inner diameter.

Next, an ink sheet cartridge 320 according to a forth embodiment of the present invention will be described while referring to FIGS. 26 to 28.

Figure 26:
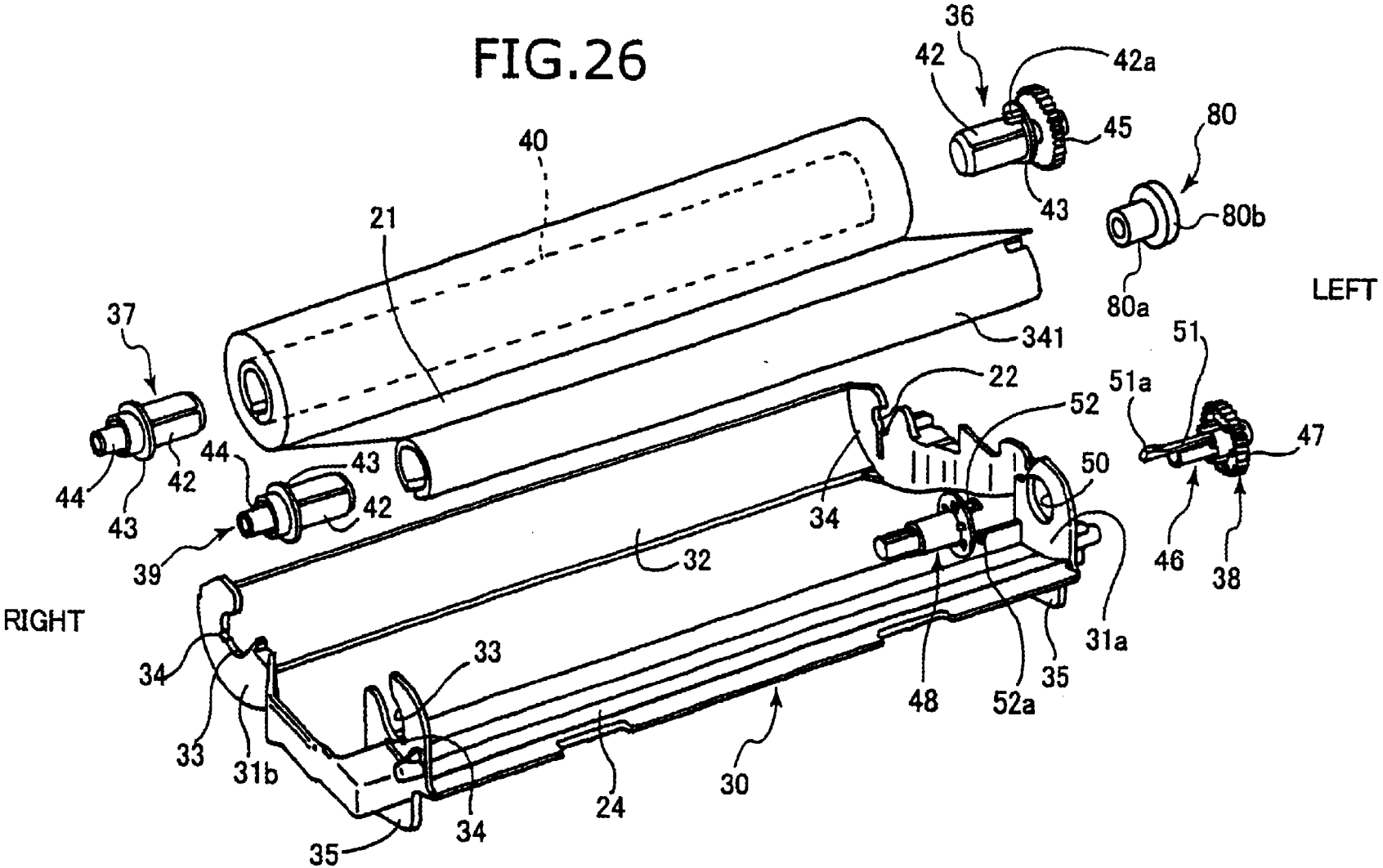
FIG. 26 is an exploded perspective view showing components of an ink sheet cartridge according to a forth embodiment of the present invention where the ink sheet cartridge is turned upside down.

As shown in FIG. 26, the ink sheet cartridge 320 of the forth embodiment has the similar configuration as the ink sheet cartridge 20 of the first embodiment. However, the ink sheet cartridge 320 includes a takeup-side core tube 341 different from the takeup-side core tube 41 and also includes a torque limiter 80 instead of the intermediate connector 56. Details will be described next. Any other components and configurations are the same as that of the first embodiment, so these components are assigned with the same numberings, and the explanation for those will be omitted.

The takeup-side core tube 341 has a left-side inner peripheral surface formed with no protrusion, and has a left-side inner diameter with a relatively small size.

Figure 27:
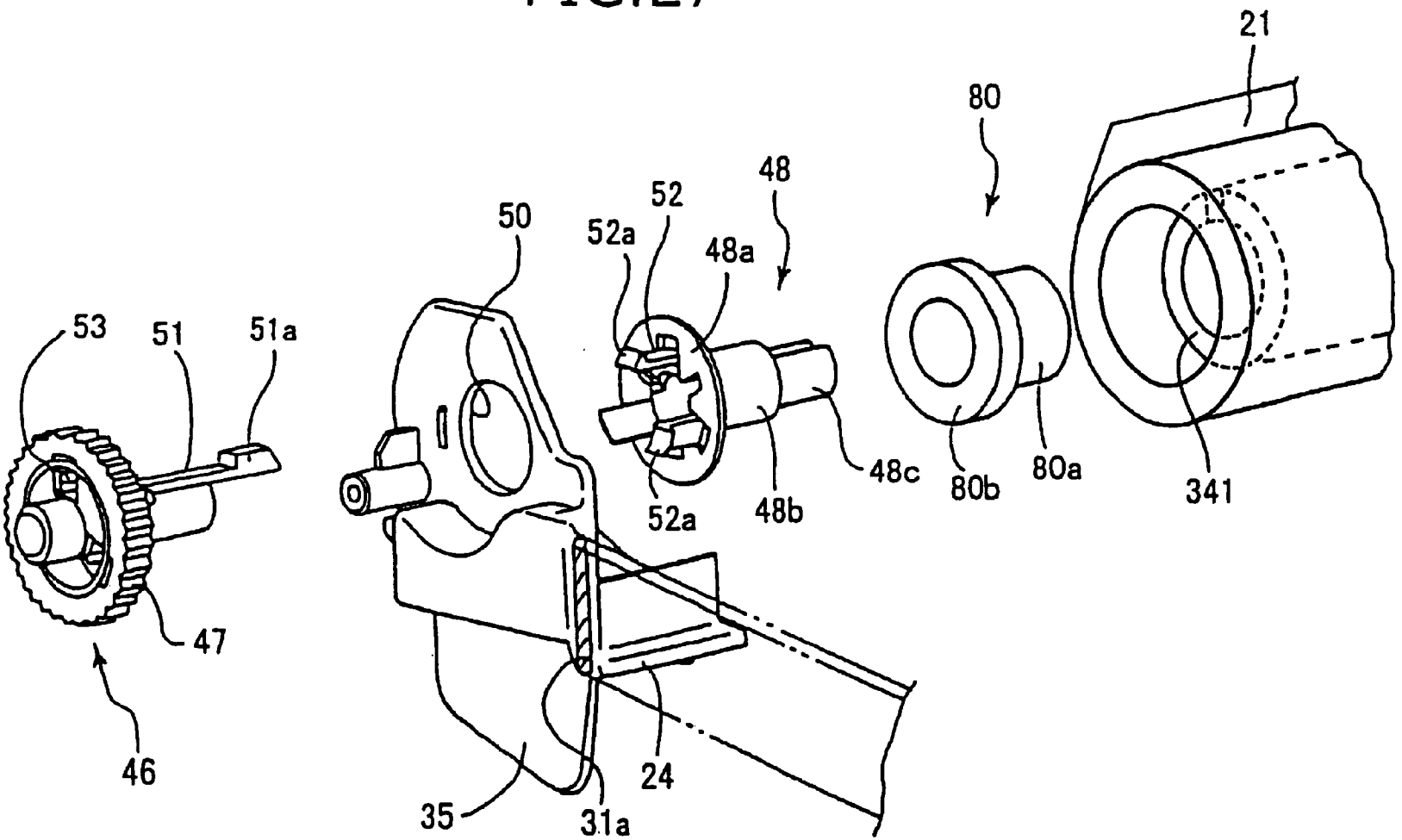
FIG. 27 is an exploded perspective view of a takeup-side left spool and other components of the ink sheet cartridge of FIG. 26.
Figure 28:
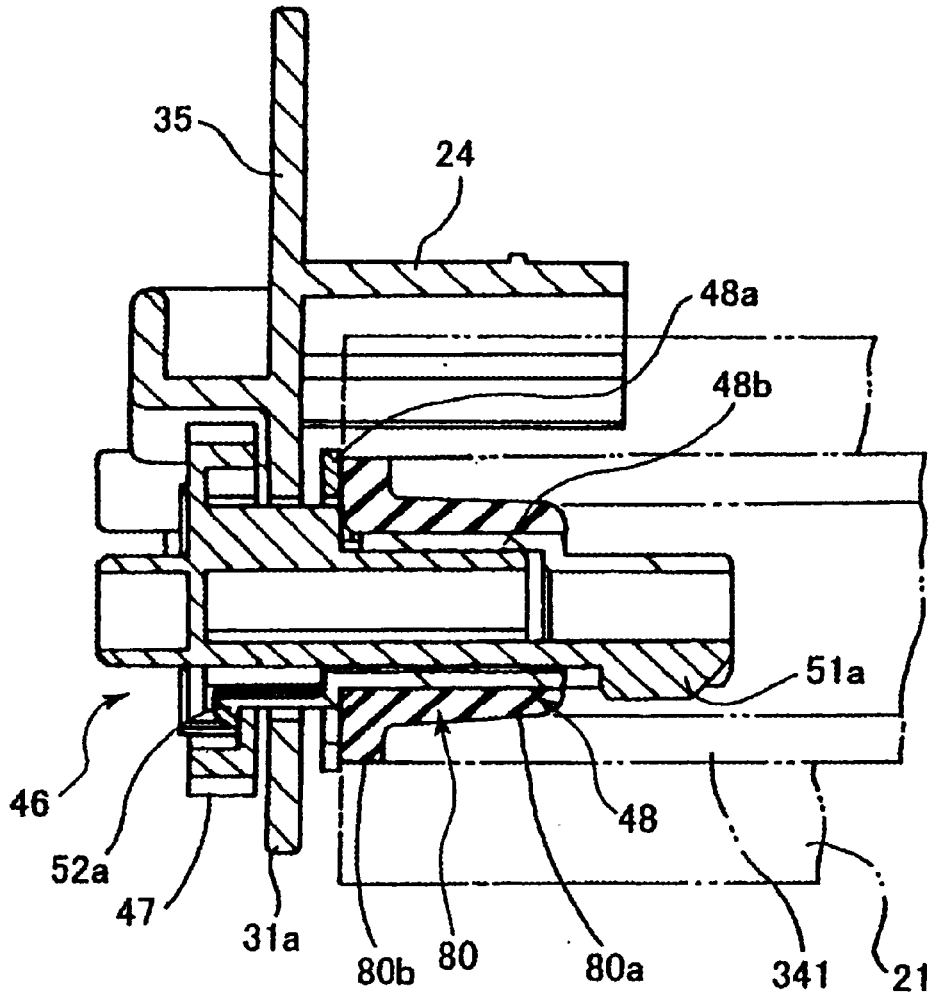
FIG. 28 is an enlarged cross-sectional view showing the complete assemble of a first rotation member, a shaft member, a torque limiter, and a takeup-side core tube of FIG. 26.

As shown in FIGS. 26 and 27, the torque limiter 80 is formed to a sleeve-like shape from a material having high friction coefficient, such as a rubber, for interposing between the sleeve base 48*b* of the takeup-side left spool 38 and the takeup-side core tube 341. The torque limiter 80 includes a small diameter sleeve portion 80*a* and a large diameter flange portion 80*b* integrally formed therewith. The sleeve portion 80*a* has an outer diameter corresponding to the left-end inner diameter of the core tube 341, so that the sleeve portion 80*a* is inserted into and fits the left end of the core tube 341.

Both the sleeve portion 80*a* and the flange portion 80*b* have an inner diameter corresponding the sleeve base 48*b* of the left spool 38, so that the sleeve base 48*b* is inserted into and fits the sleeve portion 80*a* and the flange portion 80*b*. The flange portion 80*b* is slidable on the surface of the flange 48*a* protruding from the sleeve base 48*b*.

Next, installation of an exchangeable ink-sheet set onto the cartridge body 30 of the ink sheet cartridge 320 will be described. The exchangeable ink-sheet set is a set of the supply-side core tube 40, a new ink sheet 21 wound thereover, the takeup-side core tube 341, and the torque limiter 80. If desired, the torque limiter 80 can be provisionally attached to the left end of the core tube 341. A width of the ink sheet 21 is preferably equal to a distance between the right end of the core tube 341 and the outer side end of the flange portion 80*b* of the torque limiter 80 attached to the left end of the core tube 341. A leading end of the new ink sheet 21 is provisionally attached to the outer peripheral surface of the core tube 341 by an adhesive tape.

The first rotation member 46 and the shaft member 48 are provisionally undetachably assembled together to the shaft hole 50 of the cartridge body 30 to provide the takeup-side left spool 38.

First, the takeup-side right spool 39 is inserted into the right end of the core tube 341, and the supply-side left and right spools 36 and 37 are respectively inserted into the left and right ends of the supply-side core tube 40 in a manner shown in FIG. 26.

Next, the sleeve base 48*b* of the spool 38 is inserted into the sleeve portion 80*a* of the torque limiter 80. As a result, the core tube 341 and the sleeve base 48*b* are tightly fitted together because of the resilient force of the sleeve portion 80*a* of the torque limiter 80 such that the sleeve portion 80*a* is tightly fitted into a space between the outer peripheral surface of the sleeve base 48*b* and the inner peripheral surface of the core tube 341 as shown in FIG. 28. With this configuration, the rotation force of the transmission gear 47 in the winding direction can be reliably transmitted to the core tube 341.

However, when a torque value exceeds a maximum torque value of the torque limiter 80, slippage occurs at the torque limiter 80. Therefore, excessive tension will not be imparted on the ink sheet 21, and forcible takeup of the ink sheet 21 is prevented. Accordingly, accidental breakage of the ink sheet 21 is prevented. It should be noted that the maximum torque value of the torque limiter 80 is defined as a torque value at which the torque limiter so can transmit a maximum rotation force.

Also, the maximum torque value of the torque limiter 80 can be selectively set in accordance with a thickness, a width, and a material of the ink sheet 21 to be used. Therefore, a preferable one of the torque limiters 80 can be selectively attached to the end of the core tube 341. Consequently, it is unnecessary for the user to re-set the maximum torque value at the main body side of the facsimile device 1 in accordance of the ink sheet 21 to use. Mere installation of the ink-sheet set completes the adjustment of the maximum torque value because the torque limiter 80 appropriate for the ink sheet 21 is included in the ink-sheet set.

As described above, the left end of the takeup-side core tube 341 can be inserted with only the torque limiter 80. Therefore, an ink-sheet set having a takeup-side core tube with different inner diameter, such as ink-sheet sets produced by different manufactures, cannot be used in the ink sheet cartridge 320 of the present invention. This prevents misuse of an ink sheet of other company having a quality different from that of the regular ink sheet 21 in the facsimile device 1.

Furthers only the core tube 341 having left end fitted with the torque limiter 80 can be complementarily fitted with the spool 38. In other words, a core tube of different manufacture provided with no torque limiter cannot be fitted with the spool 38 of the present invention. Therefore, misuse of the ink sheet of other manufactures having a quality different from the regular ink sheet 21 can be reliably prevented.

Consequently, degradation of printing quality and any printing deficiency caused by the misuse can be obviated.

It should be noted that the resilient member 51 and the engagement pawl 51*a* can be dispensed with in this embodiment.

While some exemplary embodiments of this invention have been described in detail, those skilled in the art will recognize that there are many possible modifications and variations which may be made in these exemplary embodiments while yet retaining many of the novel features and advantages of the invention.

For example, although the facsimile device 1 is described in the above embodiments, the present invention is available for various image forming device, such as a printer, a copying machine and a multi-function device incorporating these functions.

Also, the above-described facsimile device 1 defines the transport path for the recording sheet 4 extending in a substantially straight direction from the rear to the front of the main body case 2. However, the present invention can be also applied to a facsimile device defining a transport path extending in a U shape so that a transport direction of a recording medium is reversed. In this case, as shown in FIG. 29, the knob portion 35 for providing a grip portion to a user can be formed to the partitioning plate 24 at a position other than the left and right sides thereof.

Figure 29:
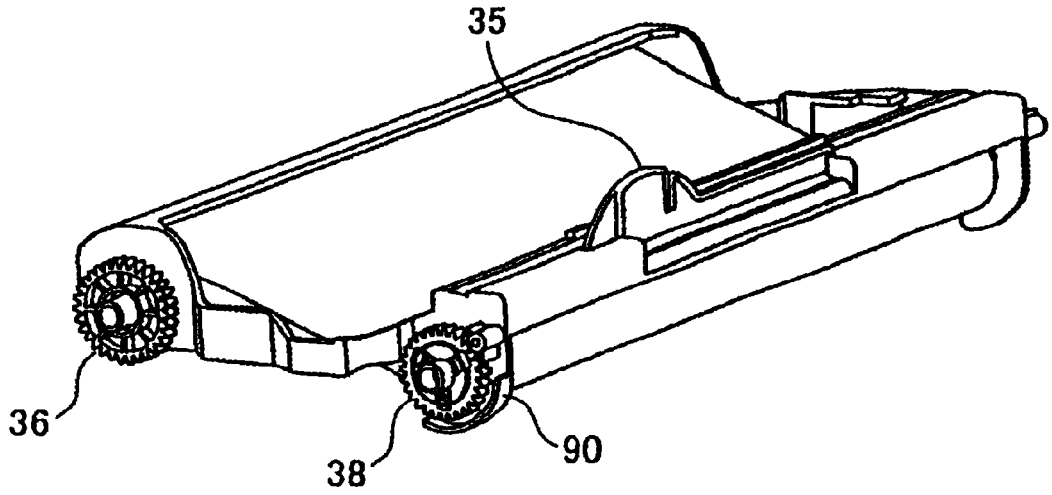
FIG. 29 is a perspective view showing an example of modified ink sheet cartridge.
Figure 30:
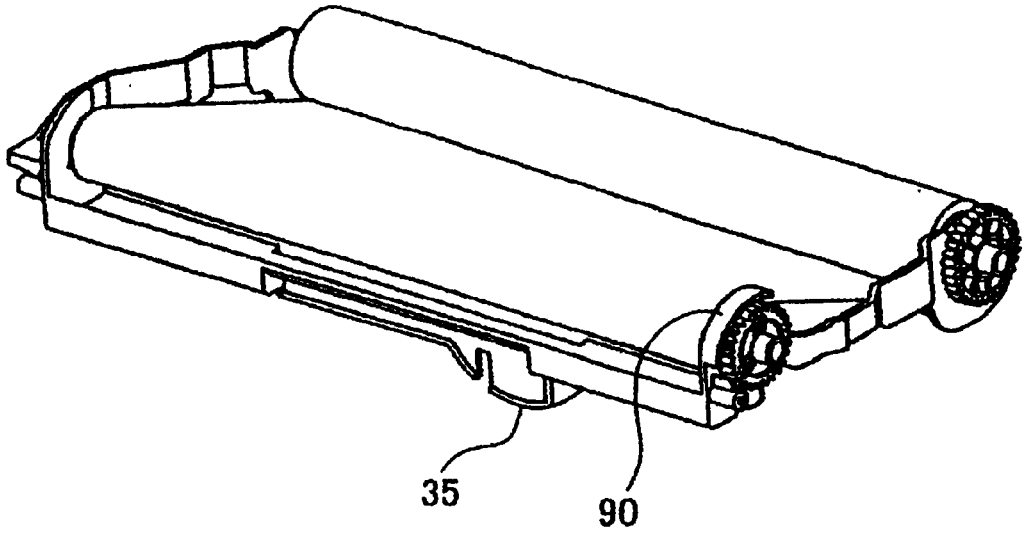
FIG. 30 is a perspective view showing the ink sheet cartridge of FIG. 29.

Also, as shown FIGS. 29 and 30, a guide plate 90 can be provided to the cartridge case so as to surround the outer periphery of the takeup-side left spool 38. Because there is no need to remove the takeup-side left spool 38 from the cartridge body 30, it is not preferable that the operator unnecessarily access the takeup-side left spool 38. The guide plate 90 prevents the user from accessing the spool 38 by an accident.

Moreover, in the above-described embodiments, the takeup-side left spool 38 is undetachable from the cartridge body 30. However, any one of the spools 36, 37, 39 can be undetachably supported by the cartridge body 30 instead of the spool 38 as long as the user can easily recognize the positions and orientations of the spools with respect to the cartridge body 30 and core tubes when replacing the ink sheet 21.

In the above-described embodiments and modifications the supply-side left spool 36 and the supply-side right spool 37 are formed as separate components. However, a supply-side spool member 400 shown in FIG. 31 can be used instead. As shown, the supply-side spool member 400 includes a left spool member 436 and a right spool member 437 connected to each other by a connection rod 450, and also includes a separate flange 443. The left spool member 436, the right spool member 437, and the connection rod 450 are formed integrally with one another. Alternatively, these components can be formed as components separated from one another and attached together by adhesive or the like.

The supply-side spool member 400 is inserted into and penetrates through the supply-side core tube 40 from its left end so that the right spool member 437 protrudes from the right end of the core tube 40. Then, the flange 43 is mounted on the right spool member 437.

Figure 32:
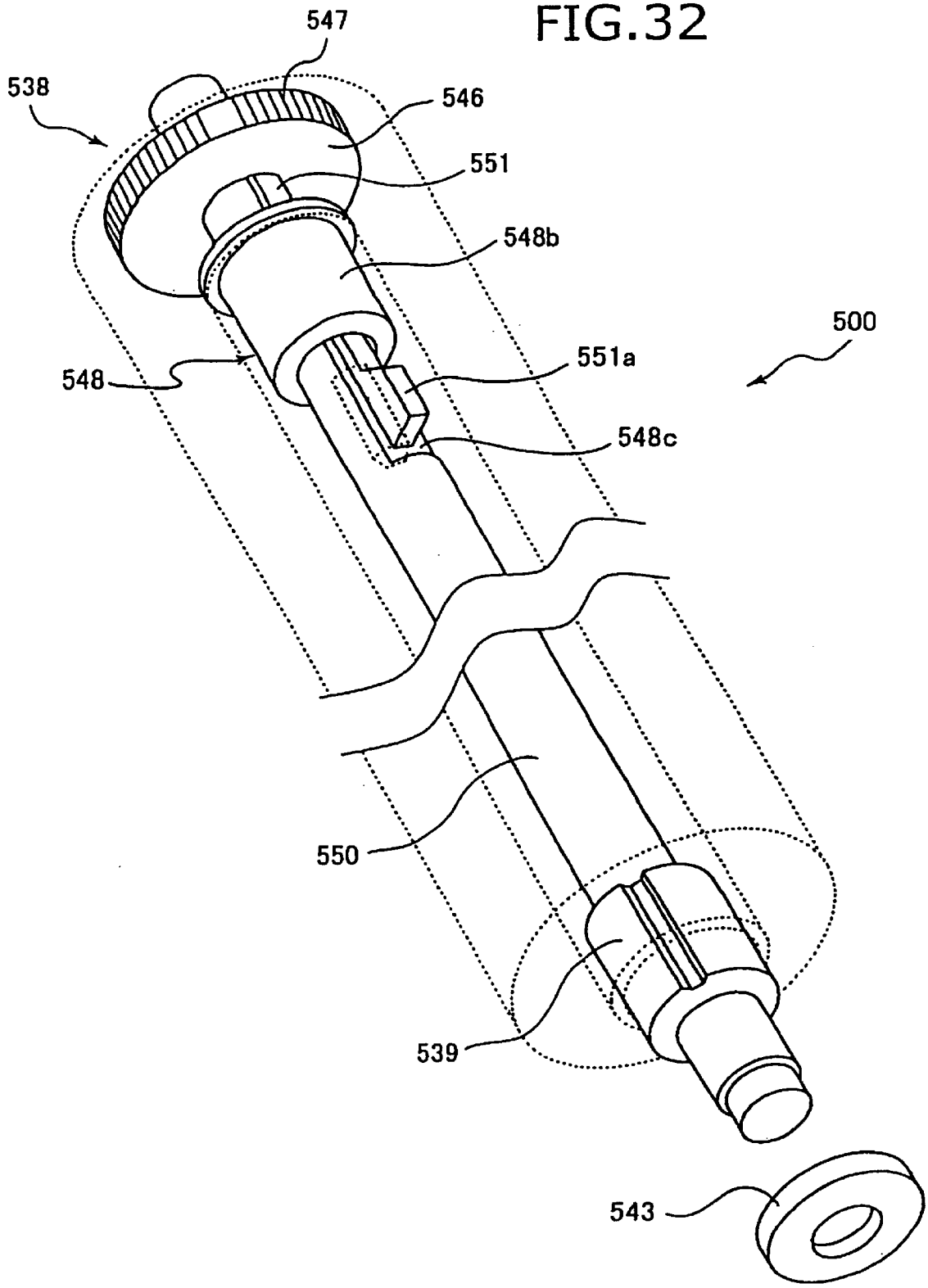
FIG. 32 is a perspective view showing a takeup-side spool member according to the present invention.
Figure 33A:
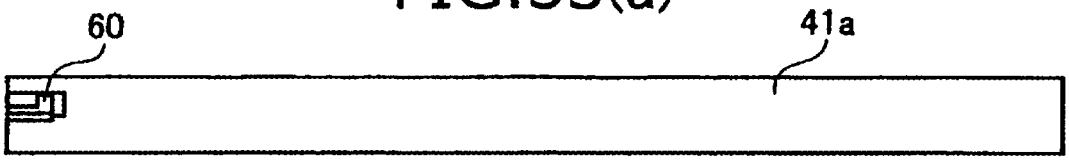
FIG. 33(*a*) is a top view of a takeup-side core tube according the first embodiment.
Figure 33B:
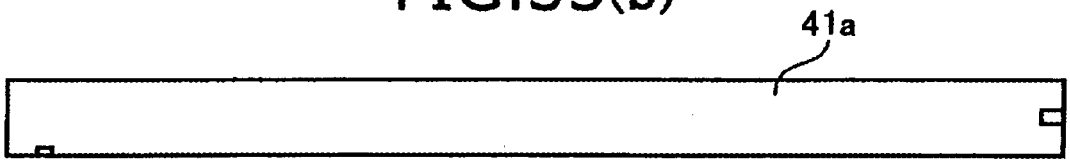
Figure 33C:
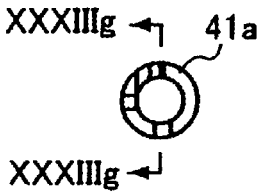
Figure 33D:
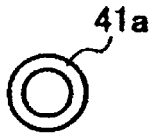
Figure 33E:
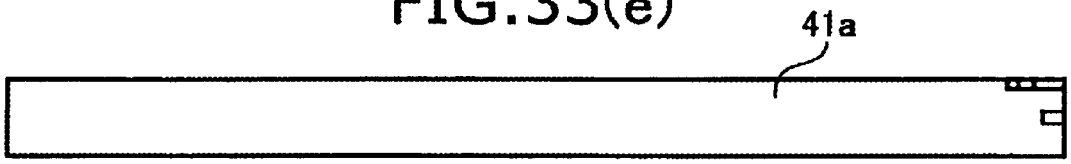
Figure 33F:
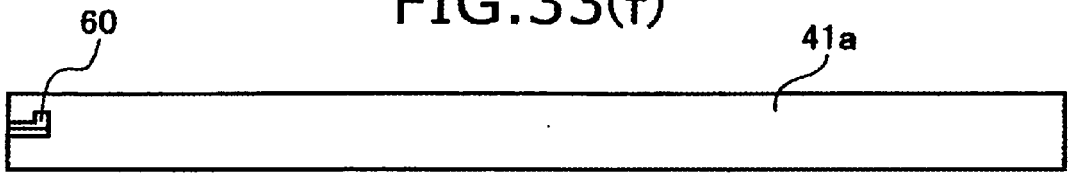
Figure 33G:
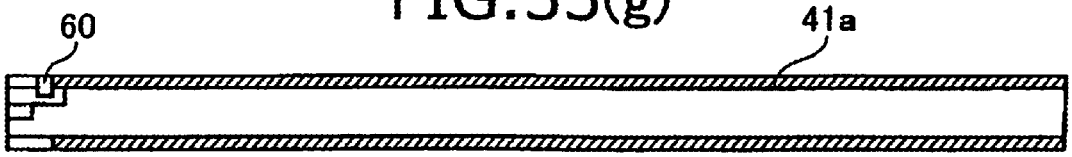
Figure 33H:
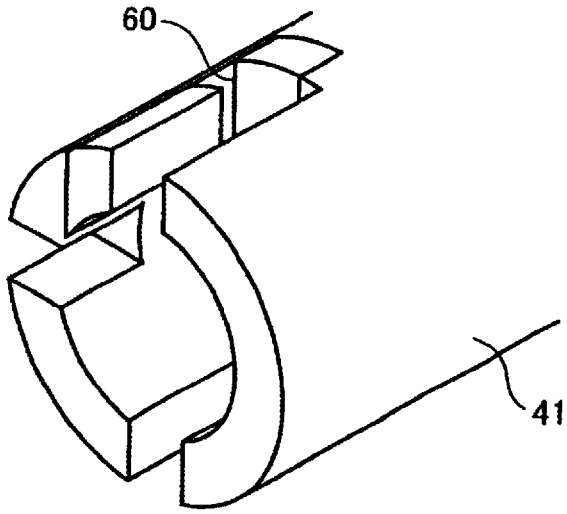
Figure 33I:
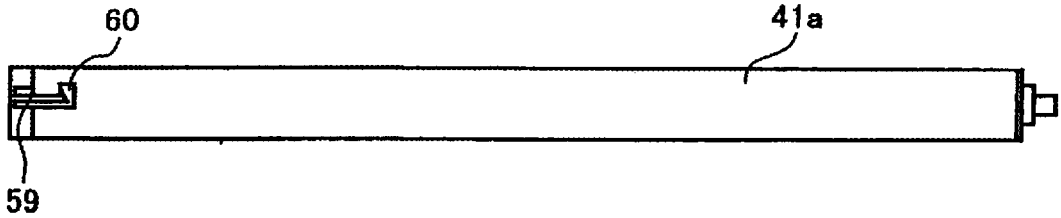
Figure 34A:
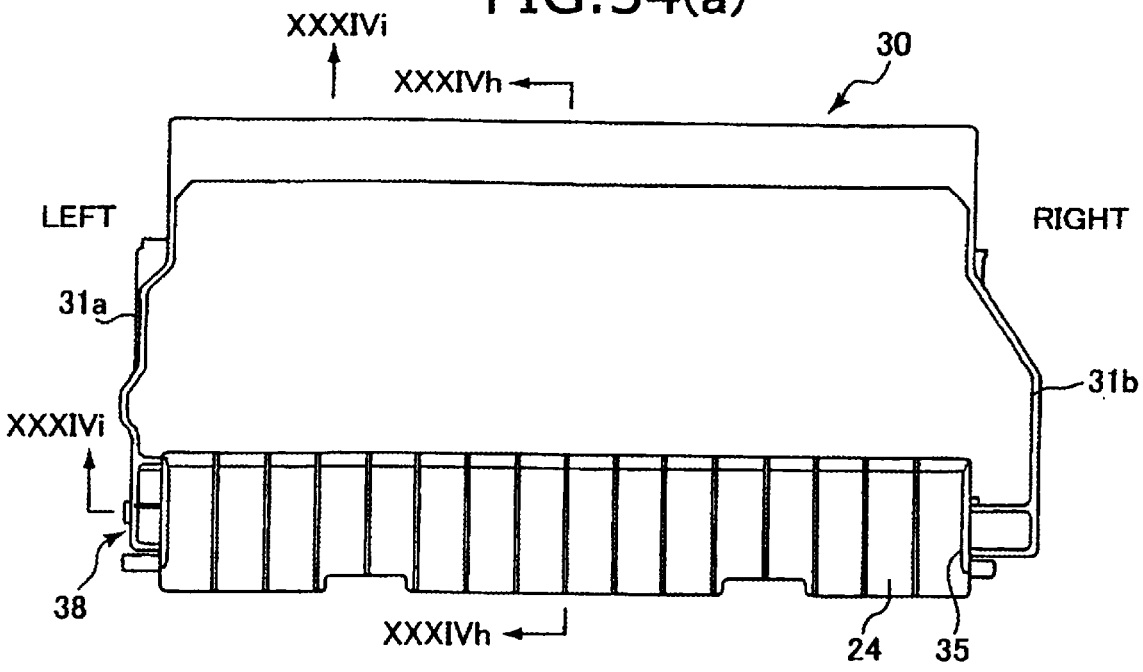
FIG. 34(*a*) is a top view of the cartridge body with the takeup-side left spool supported thereon.
Figure 34B:
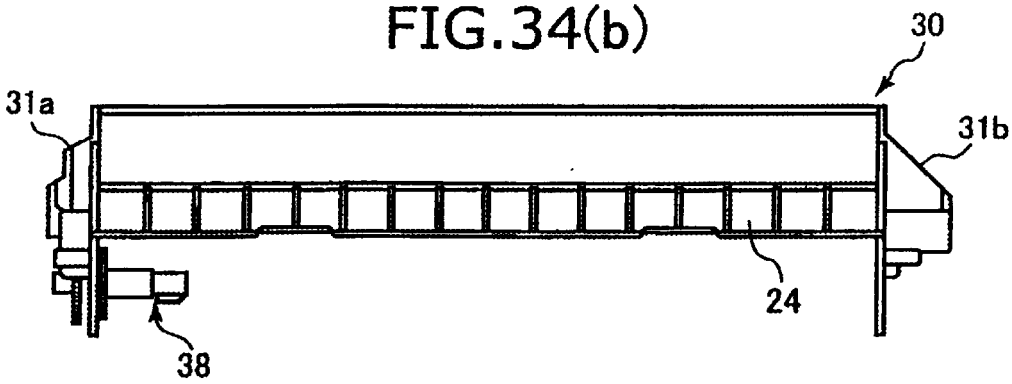
Figure 34C:
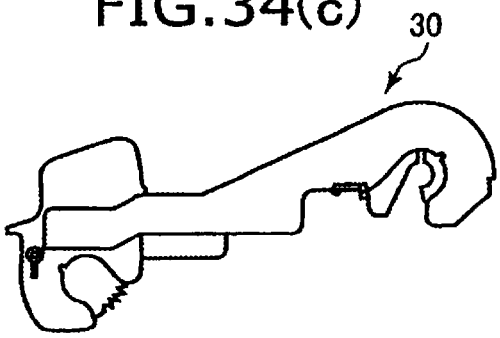
Figure 34D:
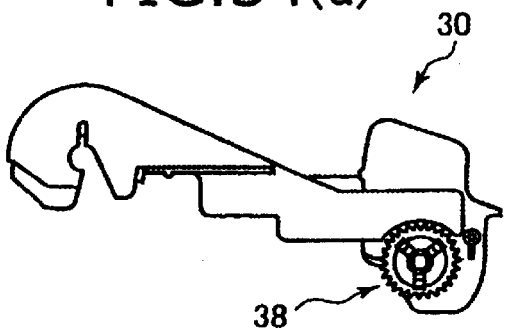
Figure 34E:
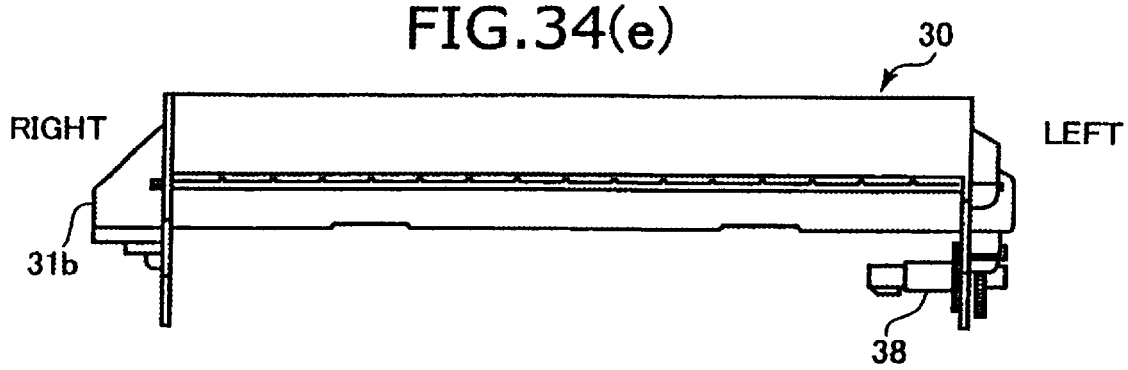
Figure 34F:
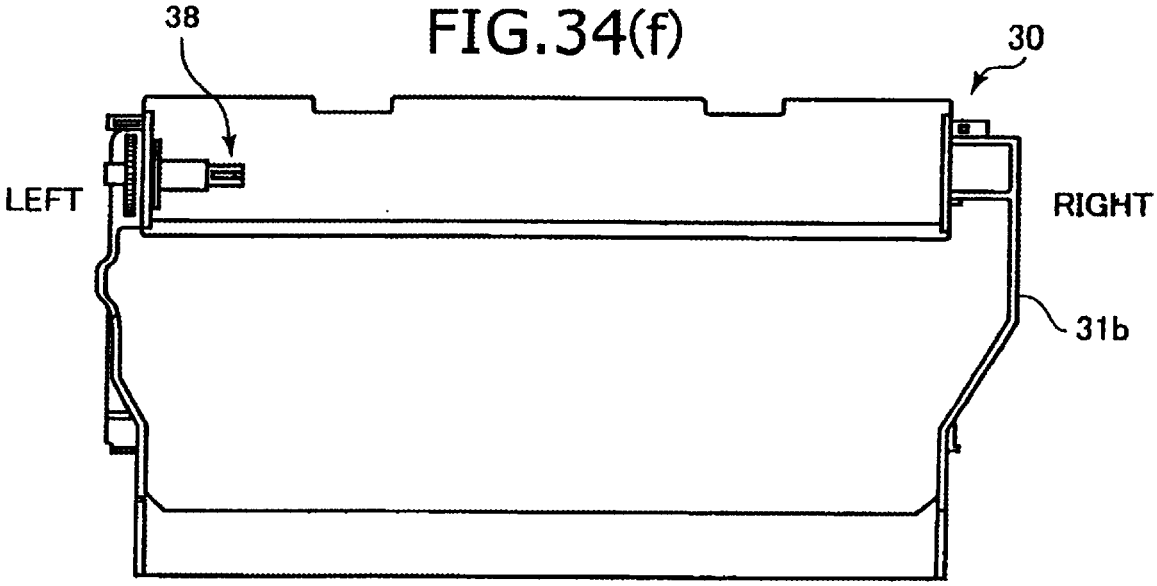
Figure 34G:
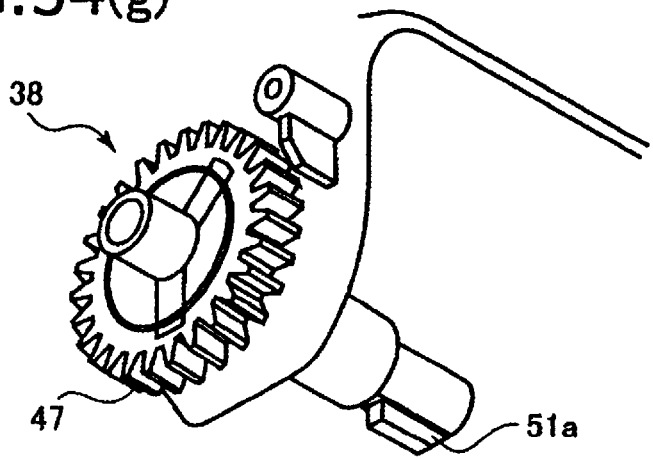
Figure 34H:
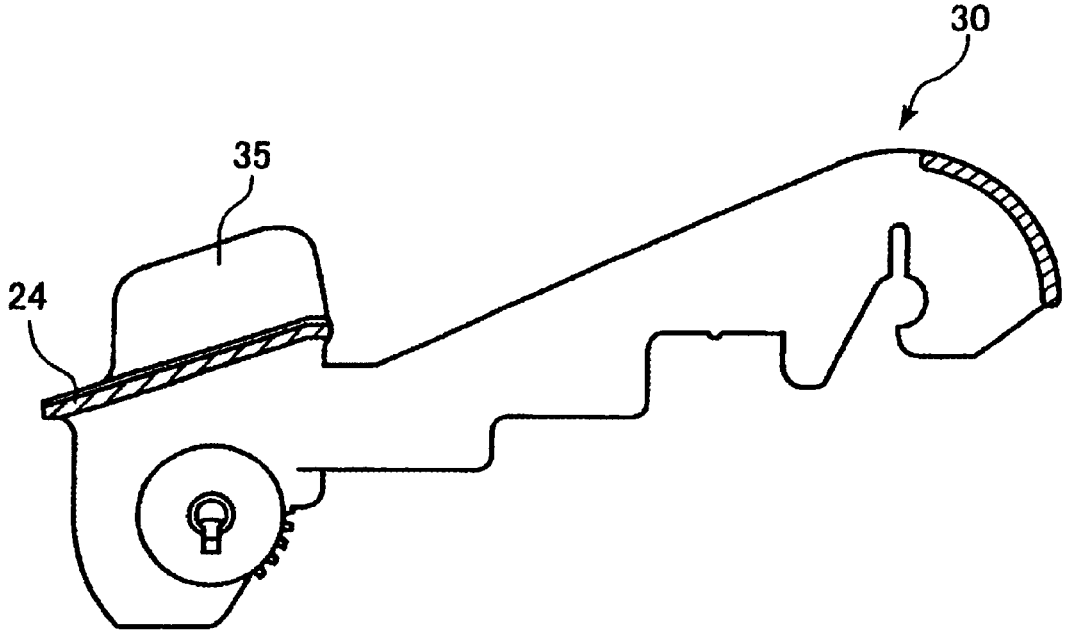
Figure 34I:
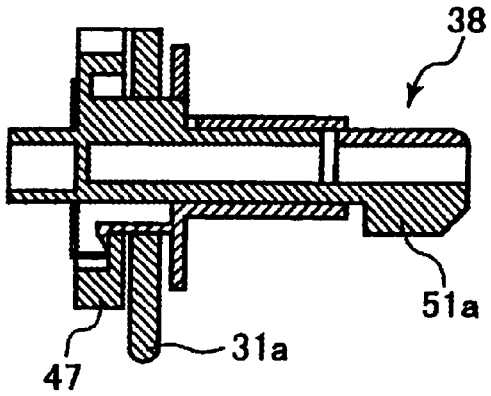

Similarly, a takeup-side spool member 500 shown in FIG. 32 can be used instead of the takeup-side left spool 38 and the takeup-side right spool 39 of the above-described second embodiment. The takeup-side spool member 500 includes a left spool member 538 and a right spool member 539 connected by a connection rod 550, and also includes a separate flange 543 engageable with the right spool member 539. The left spool member 538 includes a first rotation member 546 and a shaft member 548. The first rotation member 546 has the same configuration as that of the above-described first rotation member 46. That is, the first rotation member 546 is formed with a transmission gear 547, a resilient member 551 urged outwardly in the radial direction, an engagement pawl 551*a* formed at a tip end of the resilient member 551, and the like. The shaft member 548 is unreleasably engageable with the first rotation member 548, and has the same configuration as that of the above-described shaft member 48. That is, the shaft member 548 includes a sleeve base 548*b*, a guide portion formed with a guide groove 548*c* through which the engagement pawl 551*a* protrudes outwardly, and the like.

The takeup-side spool member 500 is inserted into and penetrates through the supply-side core tube 141 (141*a*) from its left end so that the right spool member 539 protrudes from the right end of the core tube 141 (141*a*). Then, the flange 543 is mounted on the right spool member 539.

It should be noted that although the right spool member 539 is unreleasably mounted to the left side plate 31*a* of the cartridge body 30, the takeup-side spool member 500 is able to slightly pivot with respect to the left side plate 31*a*, so that a user can replace the ink sheet without detaching the takeup-side spool member 500 from the cartridge body 30.

Figure 31:
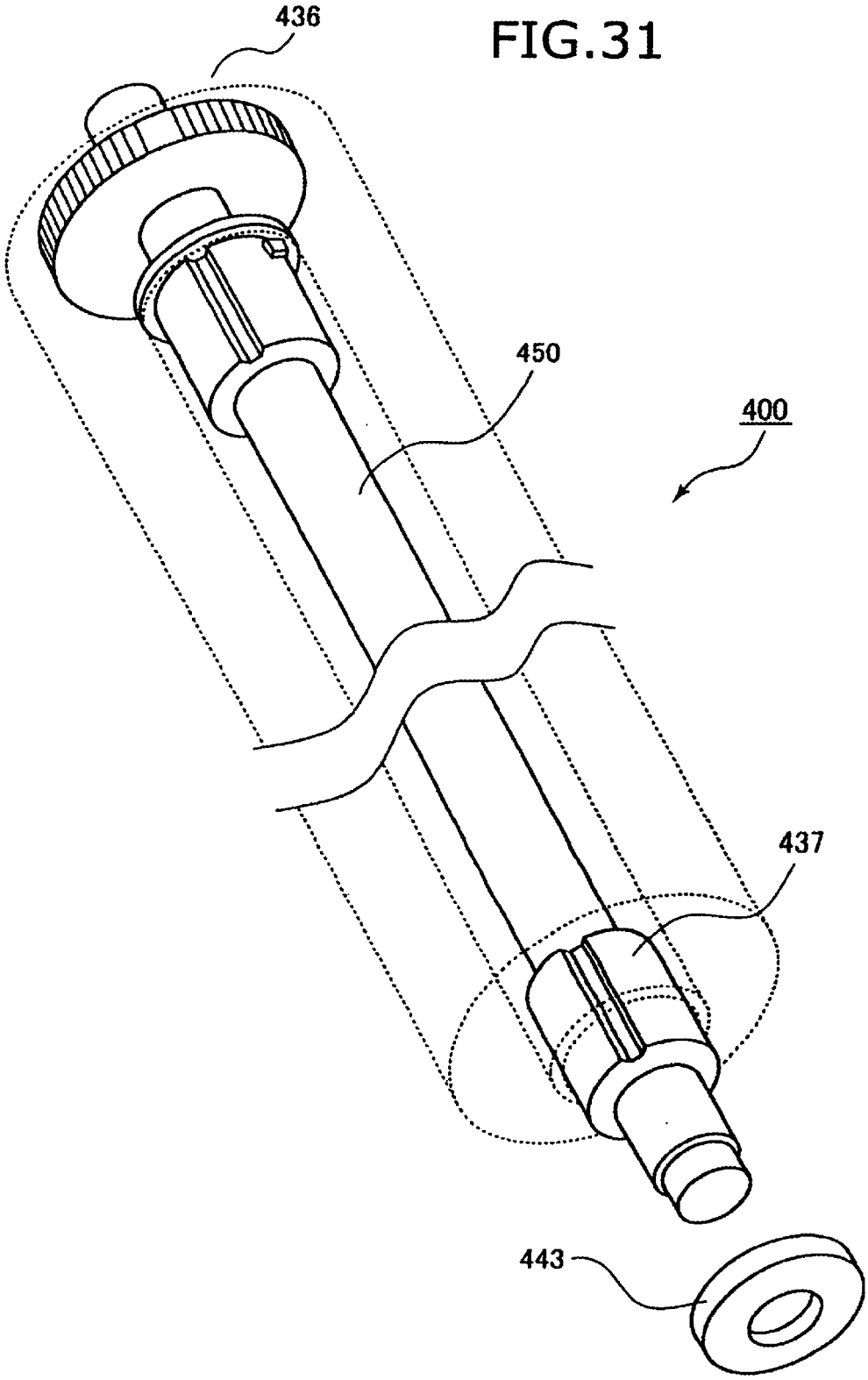
FIG. 31 is a perspective view showing a supply-side spool member according to the present invention.

Although the supply-side spool member 400 and the takeup-side spool member 500 shown in FIGS. 31 and 32 include the connection rods 450, 550 having a smaller diameter than that of the right spool members 437, 539, the connection rods 450, 550 can be dispensed with, and the right spool members 437, 539 can be formed in an extended form to integrally connect the left spool members 436, 538.

Moreover, the supply-side spool member 400 and the takeup-side spool member 500 or the connection rods 450, 550 can have a hollow inside throughout their longitudinal length.

Any combinations of ones of the supply-side left and right spools 36, 37, the takeup-side left and right spools 38, 39, the supply-side spool member 400, and the takeup-side spool member 500 can be used. That is, when the supply-side left and right spools 36, 37 and the takeup-side spool member 500 are used, three separate components are supported on the cartridge body 30. When the supply-side spool member 400 and the takeup-side left and right spools 38, 39 are used, three separate components are supported on the cartridge body 30. When the supply-side spool member 400 and the takeup-side spool member 500 are used, only two separate members are supported on the cartridge body 30.

Although in the above-described embodiments and modifications, the spool 38 is engaged with the takeup-side core tube, the ink sheet cartridge can be configured so that the spool 38 engages the supply-side core tube.

What is claimed is:

1. An ink sheet cartridge, comprising:

four spools;

a cartridge body that rotatably supports the four spools;

a supply-side core tube having two ends opposite from each other;

a takeup-side core tube having two ends opposite from each other; and an ink sheet wound around and extending between the supply-side core tube and the takeup-side core tube, wherein the four spools are detachably engaged with the corresponding ends of the supply-side core tube and the takeup-side core tube, and one of the four spools has an engagement pawl, and one of the supply-side core tube and the takeup-side core tube is provided with an engagement member for engaging the engagement pawl, wherein the one of the supply-side core tube and the takeup-side core tube has an inner peripheral surface, and the engagement member has a projection inwardly protruding from the inner peripheral surface.

2. The ink sheet cartridge according to claim 1, wherein the one of the supply-side core tube and the takeup-side core tube is formed with a receiving hole, and the projection is inserted into and penetrates the receiving hole from an outer side of the one of the supply-side core tube and the takeup-side core tube, and is fixed thereto.

3. The ink sheet cartridge according to claim 1, wherein the one of the supply-side core tube and the takeup-side core tube has a hollow inside, and the engagement member is formed with an engagement groove for engaging the engagement pawl when the engagement pawl is positioned inside the one of the supply-side core tube and the takeup-side core tube.

4. The ink sheet cartridge according to claim 1, wherein the supply-side core tube and the takeup-side core tube are detachable from the corresponding ones of the four spools without detaching the one of the four spools from the cartridge body, and the cartridge body includes a side plate formed with a support hole, and the one of the four spools includes a shaft member and a rotation member engageable with the shaft member, the shaft member including a flange and the rotation member including a resilient protrusion extending in an axial direction and a transmission gear, wherein the rotation member engages the shaft member within the support hole while the flange and the transmission gear sandwich the side plate therebetween, and the engagement pawl is provided at the tip end of the resilient protrusion.

5. An ink sheet set detachably mountable on an ink sheet cartridge including four spools and a cartridge body rotatably supporting the four spools, one of the four spools having an engagement pawl, the ink sheet set comprising:

a supply-side core tube having two ends opposite from each other;

a takeup-side core tube having two ends opposite from each other; and an ink sheet wound around and expanding between the supply-side core tube and the takeup-side core tube, wherein each of the ends of the supply-side core tube and the takeup-side core tube detachably engages a corresponding one of the four spools, and one of the supply-side core tube and the takeup-side core tube is provided with an engagement member for engaging the engagement pawl, wherein the one of the supply-side core tube and the takeup-side core tube has an inner peripheral surface, and the engagement member has a projection inwardly protruding from the inner peripheral surface.

6. The ink sheet set according to claim 5, wherein the one of the supply-side core tube and the takeup-side core tube is formed with a receiving hole, and the projection is inserted into and penetrates the receiving hole from an outer side of the one of the supply-side core tube and the takeup-side core tube, and is fixed thereto.

7. The ink sheet set according to claim 5, wherein the one of the supply-side core tube and the takeup-side core tube has a hollow inside, and the engagement member is formed with an engagement groove for engaging the engagement pawl when the engagement pawl is positioned inside the one of the supply-side core tube and the takeup-side core tube.

8. A core tube detachably mountable on an ink sheet cartridge including four spools and a cartridge body rotatably supporting the four spools, one of the four spools having an engagement pawl, the core tube comprising:

a cylindrical body having two ends opposite from each other, one of the two ends detachably engageable with the one of the four spools, wherein the cylindrical body includes an engagement member for engaging the engagement pawl, the cylindrical body has an inner peripheral surface, and the engagement member has a projection inwardly protruding from the inner peripheral surface.

9. The core tube according to claim 8, wherein the cylindrical body is formed with a receiving hole, and the projection is inserted into and penetrates the receiving hole from an outer side of the one of the supply-side core tube and the takeup-side core tube, and is fixed thereto.

10. The core tube according to claim 8, wherein the cylindrical body has a hollow inside, and the engagement member is formed with an engagement groove for engaging the engagement pawl when the engagement pawl is positioned inside the cylindrical body.

11. A core tube used in an ink sheet cartridge, comprising:

a cylindrical body having two ends detachably engageable with a specific spool having an engagement pawl, wherein the cylindrical body includes an engagement member for engaging the engagement pawl, the cylindrical body has an inner peripheral surface, and the engagement member has a projection inwardly protruding from the inner peripheral surface.

12. The core tube according to claim 11, wherein the cylindrical body is formed with a receiving hole, and the projection is inserted into and penetrates the receiving hole from an outer side of the cylindrical body and is fixed thereto.

13. The core tube according to claim 11, wherein the cylindrical body has a hollow inside, and the engagement member is formed with an engagement groove for engaging the engagement pawl when the engagement pawl is positioned inside the cylindrical body.

14. An ink sheet cartridge, comprising:

a tube-like supply-side member having two ends opposite from each other, a shaft being provided at the two ends respectively;

a tube-like takeup-side member having two ends opposite from each other, a shaft being provided at one end and a protrusion extending from an inner surface near the other end;

a specific spool detachably engageable to the other end of the tube-like takeup-side member, the specific spool having a shaft and an engageable pawl opposite to the shaft, the enagageable pawl being engageable with the protrusion of the tube-like takeup-side member;

a cartridge body that rotatably supports the shafts; and an ink sheet wound around and expanding between the tube-like supply-side member and the tube-like takeup-side member.

15. An ink sheet cartridge, comprising:

a supply-side core tube having two ends opposite from each other;

a takeup-side core tube having two ends opposite from each other;

at least two spools that includes a specific spool having an engagement pawl, each spool being detachably engageable with a corresponding core tube respectively;

a cartridge body that rotatably supports the spools; and an ink sheet wound around and expanding between the supply-side core tube and the takeup-side core tube, wherein one of the supply-side core tube and takeup-side core tube includes an engagement member for engaging the engagement pawl of the specific spool, one of the supply-side core tube and takeup-side core tube has an inner peripheral surface, and the engagement member has a projection inwardly protruding from the inner peripheral surface.

16. The ink sheet cartridge according to claim 15, wherein one of the supply-side core tube and takeup-side core tube is formed with a receiving hole, and the projection is inserted into and penetrates the receiving hole from an outer side of the core tube and is fixed thereto.

17. The ink sheet cartridge according to claim 15, wherein one of the supply-side core tube and takeup-side core tube has a hollow inside, and the engagement member is formed with an engagement groove for engaging the engagement pawl when the engagement pawl is positioned inside the core tube.

18. An ink sheet set, comprising:

a supply core tube having a first end and a second end with at least one notch in each of the first end and the second end;

a take-up core tube having a first end with at least one notch in the first end and a second end having an inner surface defining at least one receiving channel defined by at least one surface associated with the inner surface;

a pair of interchangeable first spools having an inner portion, a flange, and an outer portion, at least one protrusion extending from the flange along the inner portion, the at least one protrusion to engage the at least one notch in the first end of the supply core tube and the take-up core tube;

a second spool having an inner portion, a flange, a shaft portion, a gear and an outer portion, at least one protrusion extending from the flange along the inner portion to engage the at least one notch in the second end of the supply core tube;

a third spool having an inner portion, a flange, a shaft portion, a gear, and an outer portion, the inner portion having at least one engagement member to engage the at least one surface of the at least one receiving channel in the inner surface of the second end of the take-up core tube; and an ink sheet extending from the supply core tube to the take-up core tube.

19. The ink sheet set according to claim 18, wherein a largest diameter of the inner portion of each first spool is substantially equal to a diameter of the inner surface at the first end of the supply core tube and the take-up core tube.

20. The ink sheet set according to claim 19, wherein the inner portion of each first spool comprises a plurality of axially extending ribs on an outer surface.

21. The ink sheet set according to claim 18, wherein the at least one notch at the first end of the supply core tube and the take-up core tube is a single notch and the at least one protrusion for each of the first spools is a single protrusion.

22. The ink sheet set according to claim 18, wherein the second end of the supply core tube has a pair of notches and the second spool has a pair of corresponding protrusions.

23. The ink sheet set according to claim 22, wherein the pair of notches are offset 180° from each other.

24. An ink ribbon set, comprising:

a supply tube having a first end with a notch in the first end and a second end with at least one notch in the second end;

a take-up tube having a first end with a notch in the first end and a second end having an engaging mechanism within the second end of the take-up tube; and an ink sheet attached at one end to the supply tube and attached at a second end to the take-up tube, wherein the engaging mechanism is at least one protrusion into the core of the tube.

25. The ink ribbon set according to claim 24, wherein the at least one notch in the second end of the supply tube comprises two notches.

26. The ink ribbon set according to claim 25, wherein the pair of notches are offset 180° from each other.

27. An ink sheet ribbon, comprising:

a supply core tube having a first end and a second end with at least one notch in each of the first end and the second end;

a take-up core tube having a first end with at least one notch in the first end and a second end having an inner surface defining at least one protrusion extending inwardly; and an ink sheet extending from the supply core tube to the take-up core tube.

28. The ink sheet ribbon according to claim 27, wherein the second end of the supply core tube has a pair of notches.

29. The ink sheet ribbon according to claim 28, wherein the pair of notches in the second end of the supply core tube are offset by 180°.

30. An ink ribbon set, comprising:

a supply tube having a first end with a notch in the first end and a second end with at least one notch in the second end;

a take-up tube having a first end with a notch in the first end and a second end having an engaging mechanism within the second end of the take-up tube; and an ink sheet attached at one end to the supply tube and attached at a second end to the take-up tube, wherein the engaging mechanism is a camming mechanism having an engagement face and a cam face.

31. An ink ribbon set, comprising:

a supply tube having a first end with a notch in the first end and a second end with at least one notch in the second end;

a take-up tube having a first end with a notch in the first end and a second end having an engaging mechanism within the second end of the take-up tube; and an ink sheet attached at one end to the supply tube and attached at a second end to the take-up tube, wherein the engaging mechanism is a plurality of notches in the end of the take-up core tube, at least one notch having an L-shape.

32. An ink ribbon set, comprising:

a supply tube having a first end with a notch in the first end and a second end with at least one notch in the second end;

a take-up tube having a first end with a notch in the first end and a second end having an engaging mechanism within the second end of the take-up tube; and an ink sheet attached at one end to the supply tube and attached at a second end to the take-up tube, wherein the engaging mechanism is an inner surface of the core tube with an appropriate coefficient of friction.

* * * * *